US005449596A

United States Patent [19]

Kawai et al.

[11] Patent Number: 5,449,596

[45] Date of Patent: Sep. 12, 1995

[54] SILVER HALIDE COLOR PHOTOGRAPHIC MATERIAL

[75] Inventors: Hiroshi Kawai; Mitsuo Saitou, both of Kanagawa, Japan

[73] Assignee: Fuji Photo Film Co., Ltd., Minami Ashigara, Japan

[21] Appl. No.: 220,183

[22] Filed: Mar. 30, 1994

[30] Foreign Application Priority Data

Apr. 2, 1993 [JP] Japan ..... 5-100427
Oct. 12, 1993 [JP] Japan ..... 5-277411

[51] Int. Cl.[6] ..... G03C 1/08

[52] U.S. Cl. ..... 430/508; 430/607; 430/611; 430/613; 430/567; 430/570; 430/581; 430/583; 430/585; 430/587; 430/588

[58] Field of Search ..... 430/508, 611, 607, 613, 430/567, 570, 581, 583, 585, 587, 588

[56] References Cited

U.S. PATENT DOCUMENTS 5,185,237 2/1993 Kawai ..... 430/508

FOREIGN PATENT DOCUMENTS 1183654 7/1989 Japan .

*Primary Examiner*—Janet C. Baxter
*Assistant Examiner*—Geraldine Letscher
*Attorney, Agent, or Firm*—Burns, Doane, Swecker & Mathis

[57] ABSTRACT

There is disclosed a silver halide photographic material which is rapidly processable, high sensitive and small in variations in sensitivity between production lots of the photograhic material. The silver halide photographic material comprises a silver halide emulsion layer containing a cyan dye forming coupler, a silver halide emulsion layer containing a magenta dye forming coupler, and a silver halide emulsion layer containing a yellow dye forming coupler on a reflective support, wherein at least one layer of said silver halide emulsion layers comprises silver halide emulsion grains and compounds represented by the following general formulas (I) and (II), said emulsion grains being tabular silver halide emulsion grains having (100) planes as main planes and a silver chloride content of 90 mol % or more, and further the mean bromide ion content on surfaces of said emulsion grains is twice or more that of the whole emulsion grains:

(I)

(II)

wherein the substituents are as defined herein the specification.

18 Claims, No Drawings

SILVER HALIDE COLOR PHOTOGRAPHIC MATERIAL

FIELD OF THE INVENTION

The present invention relates to a color photographic material which can be rapidly processed and is high sensitive, and more particularly to a photographic material for a color print.

BACKGROUND OF THE INVENTION

It is well known that color photographs are formed by methods comprising processing photographic materials having dye forming couplers and silver halide emulsions on supports with aromatic primary amine color developing agents, and reacting oxidation products of the developing agents formed thereby with the dye forming couplers (hereinafter referred to as couplers) to obtain dye images.

Easy rapid processing in this color development has been very strongly required in the color photographic industry. According to this requirement, great many improvements have been achieved, and new, more easy rapid systems has been developed for every several years.

It is necessary for rapid processing that a reduction in time is separately devised for each stage of color development, bleaching-fixing, washing and drying. As a method for rapid processing, PCT International Publication No. W087-04534 discloses a method in which a high silver chloride color photographic material is rapidly processed with a color developing solution substantially free from sulfite ions and benzyl alcohol.

High silver chloride silverhalide emulsions to be used in this method are known to be generally low in sensitivity. For practical use, this has been a problem to be overcome.

High silver chloride emulsion grains are usually liable to become cubic crystalline grains having (100) outer planes. However, it is possible to form grains having (111) outer planes by existence of a grain forming controlling agent. A method for obtaining tabular high silver chloride grains having the (111) planes as main planes by forming grains in the presence of a compound containing a sulfur atom in a heterocycle is described in JP-A-63-2043 (the term "JP-A" as used herein means an "unexamined published Japanese patent application"). Tabular grains are known to be highly sensitizable by the use of a large amount of a sensitizing dye because of their large surface area.

However, the tabular high silver chloride emulsion grains having the (111) outer planes are weak in absorption of the sensitizing dye, compared with the high silver chloride emulsion grains having the (100) outer planes, which causes the problem that photographic characteristics considerably changes with time after preparation of a coating solution.

The tabular high silver chloride emulsion grains having the (100) planes as main planes have been desired to be further improved in terms of variations in sensitivity between production lots of photographic materials, or due to a storage period or storage conditions after production.

JP-A-4-323645 proposes a method for suppressing a decrease in photographic sensitivity in the infrared light region of emulsions stored in the solution state before coating and photographic materials during storage after coating by adding a thiocyanate or a selenacyanate to the high silver chloride emulsion containing the tabular high silver chloride emulsion grains having the (111) planes. However, this method is not sufficient for practical use.

SUMMARY OF THE INVENTION

It is an object of the present invention to provide a photographic material for a color print which is rapidly processable, high sensitive, and small in variations in sensitivity between production lots of photographic materials, or due to a storage period or storage conditions after production.

More specifically, the present invention intends to provide a photographic material for a color print which is high in sensitivity, low in fogging, and small in changes in sensitivity to various conditions.

DETAILED DESCRIPTION OF THE INVENTION

As a result of intensive studies, the present inventors discovered that the above-described object was attained according to the following means:

(1) A silver halide color photographic material having a silver halide emulsion layer containing a cyan dye forming coupler, a silver halide emulsion layer containing a magenta dye forming coupler, and a silver halide emulsion layer containing a yellow dye forming coupler on a reflective support, in which at least one layer of said silver halide emulsion layers comprises silver halide emulsion grains and compounds represented by the following general formulas (I) and (II), said emulsion grains being tabular silver halide emulsion grains having (100) planes as main planes and a silver chloride content of 90 mol % or more, and further the mean bromide ion content on surfaces of said emulsion grains is twice or more that of the whole emulsion grains:

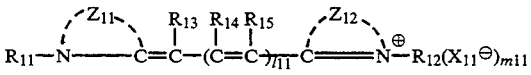

[1]

wherein $Z_{11}$ and $Z_{12}$, which may be the same or different, each represents atomic group forming 5-membered or 6-membered nitrogen-containing heterocyclic nuclei; $l_{11}$ represents 0, 1 or 2; $R_{11}$ and $R_{12}$ each represents a substituted or unsubstituted alkyl group or a substituted or unsubstituted alkenyl group; $R_{13}$ and $R_{15}$ each represents a hydrogen atom or an atomic group necessary for forming a 5-membered or 6-membered ring by combining $R_{13}$ with $R_{11}$ or $R_{15}$ with $R_{12}$; when $l_{11}$ is 2, $R_{15}$ in a central portion of a methine chain also represents a substituted or unsubstituted lower alkyl group; $R_{14}$ represents a hydrogen atom or a substituent group, or an atomic group necessary for forming a 6-membered carbon ring by combining two groups represented by $R_{14}$ which are different each other when $l_{11}$ is 2; $X_{11}$ represents a pair ion necessary for neutralization of electric charge; and $m_{11}$ represents 0 or 1, $m_{11}$ being 0 when the compound of formula (I) is an internal salt.

(II)

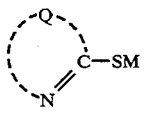

wherein Q represents an atomic group necessary for forming a 5-membered or 6-membered heterocycle or a 5-membered or 6-membered heterocycle formed by condensation of benzene rings; and M represents an cation;

(2) The silver halide color photographic material as claimed in the above embodiment (1), in which tabular grains having (100) planes as main planes and an aspect ratio (diameter/thickness) of 1.5 or more occupy 35% or more of the total of protected areas of the whole silver halide emulsion grains in the silver halide emulsion layer containing said tabular silver halide emulsion grains having a silver chloride content of 90 mol % or more, and center portions of said tabular grains having the (100) planes as main planes and an aspect ratio of 1.5 or more each has at least one gap phase discontinuous in halogen composition, said gap being a difference of 10 to 100 mol % in $Cl^-$ content or $Br^-$ content and/or a difference of 5 to 100 mol % in $I^-$ content; and (3) The silver halide color photographic material as claimed in the above embodiment (2), in which the center portions of said tabular grains having the (100) planes as main planes and an aspect ratio of 1.5 or more each has at least one gap phase discontinuous in halogen composition, said gap being a difference of 30 to 100 mol % in $Cl^-$ content or $Br^-$ content.

In the present intention, an emulsion comprising the tabular high silver chloride grains having a silver chloride content of 90 mol % or more is suitable for rapid processing, and can obtain high sensitivity compared with cubic grains. However, a coating solution of an emulsion in which these grains are spectrally sensitized with the cyanine dye of general formula (I) tends to desorb the cyanine dye with time, causing a reduction in sensitivity. In contrast, the desorption of the cyanine dye from the tabular emulsion grains can be effectively depressed by using the tabular emulsion grains in combination with the mercapto nitrogen-containing heterocyclic compound of general formula (II) according to the present invention. As a result, high sensitivity can be obtained. Further, changes in sensitivity due to the elapse of time after preparation of the coating solution can be more effectively suppressed by forming the gap phases, which are discontinuous in halogen composition in the center portions of the tabular emulsion grains of the present invention.

In the present invention, if the mean bromide ion content on the surfaces of the grains is less than twice that of the whole emulsion grains, changes with time of the coating solution is large. An aspect ratio of less than 1.5 causes the grains to be nearly cubic, so that the object of obtaining high sensitivity can not be attained. The ratio of the projected areas of the tabular grains of the present invention to the projected areas of the whole silver halide grains corresponds to the content of the tabular grains of the present invention in the silver halide emulsion layer. The percentage less than this value (35%) means that the ratio of cubic grains in the emulsion layer increases. After all, the object of obtaining high sensitivity can not be attained.

The silver chloride content of the tabular silver halide grains having the (100) planes as main planes and a silver chloride content of 90 mol % or more (hereinafter occasionally referred to as "tabular grains") used in the present invention is preferably 95 mol % or more.

The silver halide emulsion used in the present invention comprises at least a dispersion medium and the above-described silver halide grains, and the projected areas of the tabular silver halide grains having the (100) planes as main planes occupy 10% or more, preferably 35% to 100%, and more preferably 60 to 100% based on the total of the projected areas of the whole silver halide grains in the emulsion. The projected areas used herein mean the projected areas of the grains when arranged on the substrate in the state that the silver halide emulsion grains do not overlap with one another, and in the state that the main planes are parallel to substrate planes for the tabular grains. The term "main planes" means two parallel maximum outer plane in one tabular grain. The aspect ratio (diameter/thickness) of the tabular grains is preferably 1.5 or more, preferably 2 or more, more preferably 3 to 25, and further more preferably 3 to 7. Here, the term "diameter" is understood to be the diameter of a circle having the same area as the projected area of a grain observed under an electron microscope. Further, the term "thickness" means the distance between the main planes of the tabular grain. The diameter of the tabular silver halide grains is preferably 10 μm or less, more preferably 0.2 to 5 μm, and further more preferably 0.2 to 3 μm. The thickness is preferably 0.7 μm or less, more preferably 0.03 to 0.3 μm, and further more preferably 0.05 to 0.2 μm. The grain size distribution of the tabular grains is preferably monodisperse, and the coefficient of variation is preferably 40% or less, and more preferably 20% or less.

The tabular silver halide grains having the (100) planes as main planes and a silver chloride content of 90 mol % or more in the present invention can also be prepared by the method described in European Patent 0,534,395A1, page 7, line 53 to page 19, line 35, or Japanese Patent Application No. 4-214109, paragraph Nos. 0006 to 0024. However, all of these grains have no gap phases discontinuous in halogen composition in the center portions, and are of the uniform halogen composition type or of the gently changing halogen composition type. In this case, it is difficult to produce the tabular grains so as to have the required properties, which occasionally causes production variations. Further, the size distribution becomes broad, so that sensitivity, gradation, granularity, etc. are unsuitable in image quality in some cases.

In order to solve such problems, it is preferred that the grains have the gap phases discontinuous in halogen composition in the center portions thereof. The grain contains at least one gap phase discontinuous in halogen composition, preferably 2 to 4 gap phases, and more preferably 2 gap phases. The term "center portion" used herein means not only the center itself of the grain, but also the neighborhood of the center. However, the gap phase discontinuous in halogen composition nearer to the center preferably forms the tabular grain having a higher aspect ratio.

1) Concrete examples when the grain has one gap phase discontinuous in halogen composition An AgCl nucleus is laminated with AgBr (AgCl/AgBr), AgCl is laminated with AgBrI (AgCl/AgBrI), and AgClBr is laminated with AgBr (AgClBr/AgBr). More generally, they are expressed by (AgX1/AgX2), wherein X1 different from X2 in $Cl^-$ content or $Br^-$ content by 10 to 100 mol %, preferably 30 to 100 mol %, more preferably 50 to 100 mol %, and further more preferably 70 to 100 mol %. In addition to the above-described differences in $Cl^-$ content or $Br^-$ content, or singly, the difference in $I^-$ content is 5 to 100 mol %, preferably 10 to 100 mol %, more preferably 3 to 100 mol %, and further more preferably 50 to 100 mol %.

2) Concrete examples when the grain has two gap phases discontinuous in halogen composition Examples represented by the above-mentioned description include (AgBr/AgCl/AgBr), AgCl/AgBr/AgCl), (AgBrI/AgCl/AgBrI) and (AgCl/AgClBr/AgCl). More generally, they are expressed by (AgX1/AgX2/AgX3), wherein X1 and X3 may be the same or different. The gap discontinuous in halogen composition between the respective adjacent layers is as specified above.

The gap phase has the difference discontinuous in halogen composition. Specifically, the difference means that the halogen composition of a halogen salt solution (hereinafter referred to as "an $X^-$ salt solution") to be added or the halogen composition of fine silver halide grains to be added is changed at the gap phase as specified above, and does not mean the structure of the grain itself. It is particularly preferred that the gap in halogen composition is not the gap in $I^-$ content, but different in $Br^-$ content. It is further preferred that the grain has two gap phases in $Br^-$ content.

The diameter of circles equivalent to the projected areas of the silver halide grains first formed here is preferably 0.15 μm or less, more preferably 0.02 to 0.1 μm, and further more preferably 0.02 to 0.06 μm.

The thickness of the AgX2 layer is preferably an amount covering a surface of the AgX1 layer with one lattice layer on average, more preferably an amount covering the AgX1 layer with from 3 lattice layers to 10-fold molar amount of the AgX1 layer, and further more preferably an amount covering the AgX1 layer with from 10 lattice layers to 3-fold molar amount of the AgX1 layer. It is preferred that the gap structure is equal between the grains. This is because the grains equal in (the number of screw dislocation/grain) are formed, and because the tabular grains having a narrow grain size distribution are formed. The term "screw dislocation" means a defect responsible for anisotropic growth generated when an aqueous solution of silver nitrate and an aqueous solution of a halide (salt) are added to a solution of a dispersion medium containing at least a dispersion medium (gelatin, etc.) and water to form nuclei.

The grains contained in the emulsion may be the same or different from-one another in halogen composition. However, the use of an emulsion containing grains each of which has the same halogen composition easily homogenize the properties of each grain.

In the present invention, bromide ions are required to be localized on surfaces of the grains. The content of bromide ions on the grain surfaces to the mean content of bromide ions in the whole grains is preferably twice or more, more preferably 3 to 200 time, and further more preferably 5 to 100 times. The term "surface" defined in the present invention means a surface in the range measured by the XPS (X-ray photoelectron spectroscopy) method. Details of this measuring method are described in Someno and Yasumori, *Hyomen Bunseki (Surface Analysis)*, Kodansha (1977).

In such high silver chloride emulsions grains, the grains are preferred which have the structure of having silver bromide-localized phases on the surfaces of the silver halide grains in the layer form or in the non-layer form. The silver bromide content of the halogen composition in the above-described localized phases is preferably at least 10 mol %, and more preferably above 20 mol %. These localized phases can exist on edges, corners or surfaces of the grains. One preferred example thereof includes one formed on the corner portions of the grain by epitaxial growth. The high bromine ion concentration on the grain surface can be achieved by adding a slightly soluble bromide such as silver bromide, a water soluble bromide such as potassium bromide, or a bromide ion donating compound such as a bromide ion sustained release agent as described in U.S. Pat. No. 5,061,615 during the period from before initiation of chemical sensitization to coating of the emulsion.

It is preferred that the silver halide grains contained in the silver halide emulsions used in the present invention have a mean grain size of 0.1 to 2 μm. The mean grain size is a number mean value of grain sizes represented by the diameters of circles equivalent to the projected areas of the grains.

Further, it is preferred that these emulsions are so-called monodisperse emulsions having a narrow grain size distribution, namely, a coefficient of variation (the standard deviation of the grain size distribution divided by the mean grain size) of not more than 20%, desirably not more than 15%. At this time, for the purpose of obtaining a wide latitude, the above-described monodisperse emulsions are preferably blended in the same layer or coated in multiple layers.

The silver chlorobromide emulsions used in the present invention can be prepared according to the methods described in P. Glafkides, *Chimie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). Namely, any of an acid process, a neutral process and an ammonia process may be used. A soluble silver salt and a soluble halogen salt may be reacted with each other by using any of a single jet process, a double jet process and a combination thereof. A so-called reverse mixing process in which grains are formed in the presence of excess silver ions can also be used. As a type of double jet process, a process for maintaining the pAg in a liquid phase constant in which a silver halide is formed, namely a so-called controlled double jet process, can also be used. According to this process, a silver halide emulsion having a regular crystal form and an approximately uniform grain size can be obtained.

In the course of formation of grain emulsions or physical ripening, various multivalent metal ion dopants can be introduced in the silver halide emulsions used in the present invention. Examples of compounds used include salts of cadmium, zinc, lead, copper and thallium, salts of the Group VIII metals of the Periodic Table, such as iron, ruthenium, rhodium, palladium, osmium, iridium and platinum, and complex salts thereof. In particular, the dopants of the Group VIII metals of the Periodic Table can be preferably used. Although the addition amount of these compounds varies over a wide range depending on their object, it is preferably $10^{-9}$ to $10^{-2}$ mol per mol of silver halide.

These metal ions are preferably used in the complex ion form among others. Ligands preferably used include groups and molecules such as cyano, isocyano, thiocyano, nitrosyl, thionitrosyl, amine and hydroxyl.

The silver halide emulsions used in the present invention are generally subjected to chemical sensitization and spectral sensitization.

With respect to the chemical sensitization, chalcogenide sensitization using sulfur, selenium, tellurium, etc., noble metal sensitization represented by gold sensitization, and reduction sensitization can be used alone or in combination. The compounds described on page 18, lower right column over to page 22, upper right column of JP-A-62-215272 are preferably used for chemical sensitization.

The spectral sensitization is carried out for the purpose of giving spectral sensitivity in a desired light wavelength range to an emulsion of each layer of the photographic material of the present invention. In the present invention, it is preferred that the spectral sensitization is carried out by adding a dye which absorbs light in a wavelength range corresponding to a desired spectral sensitivity, namely a spectrally sensitizing dye. The spectrally sensitizing dyes used in the present invention include at least one kind of compound represented by general formula (I).

In general formula (1), $Z_{11}$ and $Z_{12}$, which may be the same or different, each represents atomic group forming 5-membered or 6-membered nitrogen-containing heterocyclic nuclei, and $l_{11}$ represents 0, 1, or 2. When $l_{11}$ is 0 or 1, $Z_{11}$ and $Z_{12}$, which may be the same or different, are preferably heterocyclic nuclei such as thiazole, benzothiazole, naphthothiazole, dihydronaphtho-thiazole, selenazole, benzoselenazole, naphthoselenazole, dihydronaphthoselenazole, oxazole, benzoxazole, naphthoxazole, benzimidazole, naphthimidazole, pyridine, quinoline, imidazo[4,5-b]quinoxaline and 3,3-dialkylindolenine. When $l_{11}$ is 2, $Z_{11}$ and $Z_{12}$, which may be the same or different, represent heterocyclic nuclei such as benzothiazole, benzoselenazole, benzoxazole, naphthoxazole, benzimidazole, naphthimidazole, etc.

The above-described nitrogen-containing heterocyclic nuclei represented by $Z_{11}$ and $Z_{12}$ may have one or more substituents. When the nitrogen-containing heterocyclic nuclei represented by $Z_{11}$ and $Z_{12}$ are nuclei other than benzimidazole and naphthimidazole, preferred examples of the substituents include lower alkyl groups [which may be branched or may further have substituents (for example, hydroxyl, halogen, aryl, aryloxyl, arylthio, carboxyl, alkoxyl, alkylthio, alkoxycarbonyl, etc.), more preferably, alkyl groups each having 8 or less carbon atoms (for example, methyl, ethyl, butyl, chloroethyl, 2,2,3,3-tetrafluoropropyl, hydroxyl, benzyl, carboxypropyl, methoxyethyl, ethylthioethyl, ethoxycarbonylethyl)]; lower alkoxyl groups (which may further have substituents examples of which include the same substituents as described as the examples of the substituents for the above-described alkyl groups, more preferably, alkoxyl groups each having 8 or less carbon atoms such as methoxy, ethoxy, pentyloxy, ethoxymethoxy, methylthioethoxy, phenoxyethoxy, hydroxyethoxy and chloropropoxy); a hydroxyl group; halogen atoms; aryl groups (for example, phenyl, tolyl, anisyl, chlorophenyl and carboxyphenyl); aryloxy group (for example, tolyloxy, anisyloxy, phenoxy and chlorophenoxy); arylthio groups (for example, tolylthio, chlorophenylthio and phenylthio); lower alkylthio groups [which may further have substituents examples of which include the same substituents as described as the examples of the substituents for the above-described lower alkyl groups, more preferably, alkylthio groups each having 8 or less carbon atoms (for example, methylthio, ethylthio, hydroxyethylthio, carboxyethylthio and benzylthio)]; acylamino groups (more preferably, acylamino groups each having 8 or less carbon atoms such as acetylamino, benzoylamino, methanesulfonylamino and benzenesulfonylamino); a carboxyl group; lower alkoxycarbonyl groups (more preferably, alkoxycarbonyl groups each having 6 or less carbon atoms such as ethoxycarbonyl and butoxycarbonyl); perfluoroalkyl groups (more preferably, perfluoroalkyl groups each having 5 or less carbon atoms such as trifluoromethyl and difluoromethyl); and acyl groups (more preferably, acyl groups each having 8 or less carbon atoms such as acetyl, propionyl, benzoyl and benzenesulfonyl). When the nitrogen-containing heterocyclic nucleus represented by $Z_{11}$ and $Z_{12}$ is benzimidazole or naphthimidazole and $l_{11}$ is 0 or 1, preferred examples of the substituents include halogen atoms, a cyano group, a carboxyl group, lower alkoxycarbonyl groups (more preferably, alkoxycarbonyl groups each having 6 or less carbon atoms such as ethoxycarbonyl and butoxycarbonyl); perfluoroalkyl groups (more preferably, perfluoroalkyl groups each having 5 or less carbon atoms such as trifluoromethyl and difluoromethyl); and acyl groups (more preferably, acyl groups each having 8 or less carbon atoms such as acetyl, propionyl, benzoyl and benzenesulfonyl). When $l_{11}$ is 2, preferred examples of the substituents include halogen atoms, a cyano group, a carboxyl group and lower alkoxycarbonyl groups each having 5 or less carbon atoms.

Examples of the nitrogen-containing heterocyclic nuclei represented by $Z_{11}$ and $Z_{12}$ include, for example, benzothiazole, 5-methylbenzothiazole, 6-methylbenzothiazole, 5-ethylbenzothiazole, 5,6-dimethylbenzothiazole, 5-methoxybenzothiazole, 6-methoxybenzothiazole, 5-butoxybenzothiazole, 5,6-dimethoxybenzothiazole, 5-methoxy-6-methylbenzothiazole, 5-chlorobenzothiazole, 5-chloro-6-methylbenzothiazole, 5-phenylbenzothiazole, 5-acetylaminobenzothiazole, 6-propionylaminobenzothiazole, 5-hydroxybenzothiazole, 5-hydroxy-6-methylbenzothiazole, 5-ethoxycarbonylbenzothiazole, 5-carboxybenzothiazole, naphtho[1,2-d]thiazole, naphtho[2,1-d]thiazole, 5-methylnaphtho[1,2-d]thiazole, 8-methoxynaphtho[1,2-d]thiazole, 8,9-dihydronaphthothiazole, 3,3-dipropylindolenine, 3,3-dipropylindolenine, 3,3-dimethylindolenine 3,3,5-trimethyl-indolenine, benzoselenazole, 5-methylbenzoselenazole, 6 -methylbenzoselenazole, 5-methoxybenzoselenazole, 6-methoxybenzoselenazole, 5-chlorobenzoselenazole, 5,6-dimethylbenzoselenazole, 5-hydroxybenzoselenazole, 5-hydroxy-6-methylbenzoselenazole, 5,6-dimethoxybenzoselenazole, 5-ethoxylcarbonylbenzoselenazole, naphtho[1,2-d]selenazole, naphtho[2,1-d]selenazole, benzoxazole, 5-hydroxybenzoxazole, 5-methoxybenzoxazole, 5-phenylbenzoxazole, 5-phenethylbenzoxazole, 5-phenoxybenzoxazole, 5-chlorobenzoxazole, 5-chloro-6-methylbenzoxazole, 5-phenylthiobenzoxazole, 6-ethoxy-5-hydroxybenzoxazole, 6-methoxybenzoxazole, naphtho[1,2-d]oxazole, naphtho[2,1-d]oxazole, naphtho[2,3-d]oxazole, 1-ethyl-5-cyanobenzimidazole, 1-ethyl-5-chlorobenzimidazole, 1-ethyl-5,6-dichlorobenzimidazole, 1-ethyl-6-chloro-5-cyanobenzimidazole, 1-ethyl-6-chloro-5-trifluoromethylbenzimidazole, 1-ethyl-5,6-dichlorobenzimidazole, 1-ethyl-6-fluoro-5-cyanobenzimidazole, 1-propyl-5-butoxycarbonylbenzimidazole, 1-benzyl-5-methylsulfonylbenzimidazole, 1-allyl-5-chloro-6-acetylbenzimidazole, 1-ethylnaphtho[1,2-d]imidazole, 1-ethylnaphtho[2,3-d]imidazole, 1-ethyl-6-chloronaphtho[2,3-d]imidazole, 2-quinoline, 4-quinoline, 8-fluoro-4-quinoline, 6-methyl-2-quinoline, 6-hydroxy-2-quinoline and 6-methoxy-2quinoline.

$R_{11}$ and $R_{12}$, which may be the same or different, represent alkyl groups or alkenyl groups each having 10 or less carbon atoms which may be substituted. Preferred examples of the substituents for the alkyl groups and the alkenyl groups include a sulfo group, a carboxyl group, halogen atoms, a hydroxyl group, alkoxyl groups each having 6 or less carbon atoms, aryl groups each having 8 or less carbon atoms which may be substituted (for example, phenyl, tolyl, sulfonyl and carboxyphenyl), heterocyclic groups (for example, furyl and thienyl), aryloxy groups each having 8 or less carbon atoms which may be substituted (for example, chlorophenoxy, phenoxy, sulfophenoxy and hydroxyphenoxy), acyl groups each having 8 or less carbon atoms (for example, benzenesulfonyl, methanesulfonyl, acetyl and propionyl), alkoxycarbonyl groups each having 6 or less carbon atoms (for example, ethoxycarbonyl and butoxycarbonyl), an cyano group, alkylthio groups each having 6 or less carbon atoms (for example, methylthio and ethylthio), arylthio groups each having 8 or less carbon atoms which may be substituted (for example, phenylthio and tolylthio), carbamoyl groups each having 8 or less carbon atoms (for example, carbamoyl and N-ethylcarbamoyl), and acylamino groups each having 8 or less carbon atoms (for example, acetylamino and methanesulfonyl-amino). One or more substituents of these may be contained.

Examples of the groups represented by $R_{11}$ and $R_{12}$ include, for example, methyl, ethyl, propyl, allyl, pentyl, hexyl, methoxyethyl, ethoxyethyl, phenetyl, tolylethyl, sulfophenetyl, 2,2,2-trifluoroethyl, 2,2,3,3-tetrafluoropropyl, carbamoylethyl, hydroxyethyl, 2-(2-hydroxyethoxy)-ethyl, carboxymethyl, carboxyethyl, ethoxycarbonylmethyl, sulfoethyl, 2-chloro-3-sulfopropyl, 3-sulfopropyl, 2-hydroxy-3-sulfopropyl, 3-sulfobutyl, 4-sulfobutyl, 2-(2,3-dihydroxypropoxy)ethyl and 2-[2-(3-sulfopropoxy)ethoxy]ethyl.

$R_{13}$ and $R_{15}$ represent hydrogen atoms. $R_{13}$ and $R_{15}$ may be combined with $R_{11}$ and $R_{12}$, respectively, to form 5-membered or 6-membered rings. When $l_{11}$ is 2, $R_{15}$ in a central portion of the methine chain also represents a lower alkyl group (which may be substituted, for example, methyl, ethyl, propyl, methoxyethyl, benzyl and phenetyl).

$R_{14}$ represents a hydrogen atom or a substituent. Examples of the substituents include aryl groups (for example, phenyl), alkylthio groups (for example, ethylthio), and lower alkyl groups (which may be substituted, for example, methyl, ethyl, propyl, methoxyethyl and phenetyl, more preferably, alkyl groups each having 5 or less carbon atoms). When $l_{11}$ is 2, $R_{14}$ and the other $R_{14}$ different from each other may also combine with each other to form a 6-membered carbon ring.

$X_{11}$ represents a pair ion necessary for neutralization of electric charge.

$m_{11}$ presents 0 or 1, and 0 for an internal salt.

Examples of the sensitizing dyes represented by general formula (I) are listed below in order to illustrate the present invention in more detail, but the invention should not be limited to these compounds.

I-1

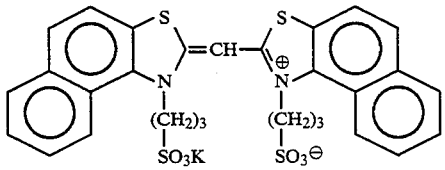

I-2

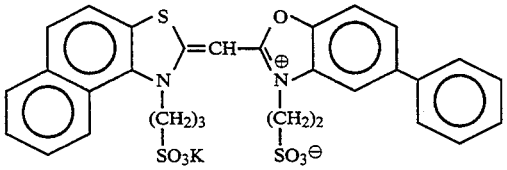

I-3

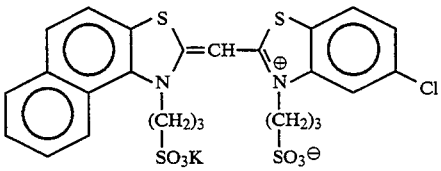

I-4

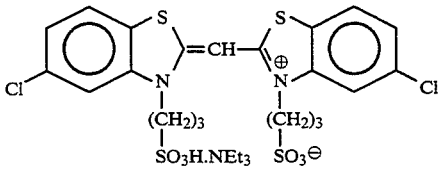

I-5

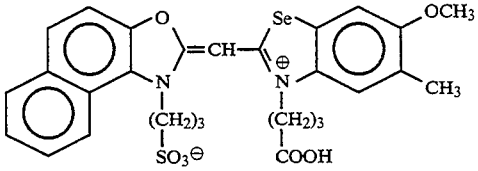

I-6

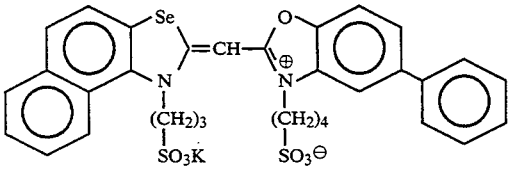

I-7

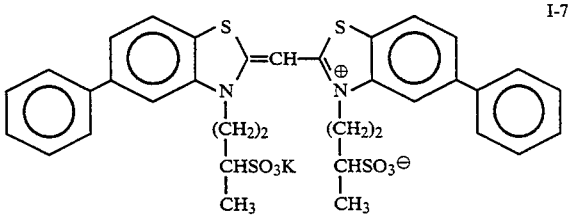

I-8

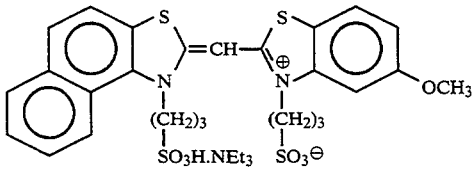

-continued
I-9
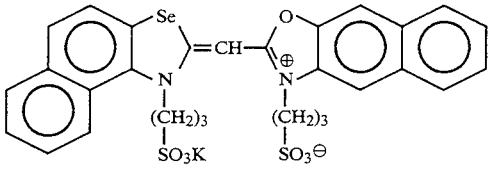
I-10
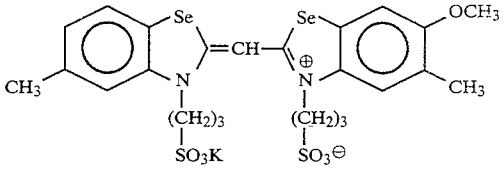
I-11
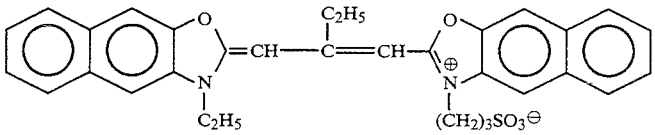
I-12
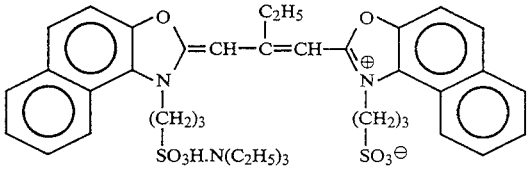
I-13
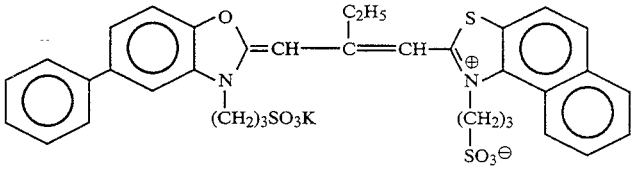
I-14
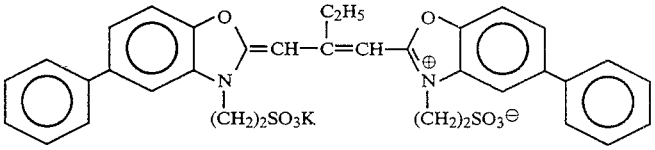
I-15
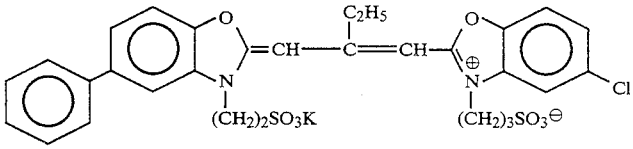
I-16
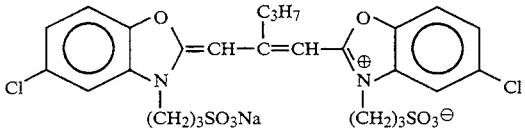
I-17
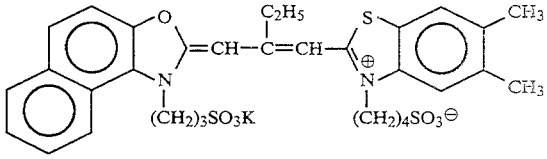
I-18
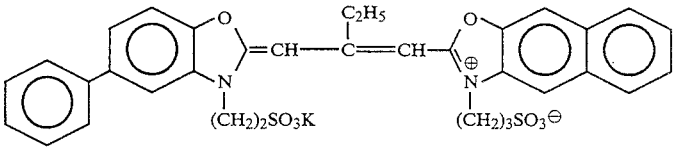
I-19
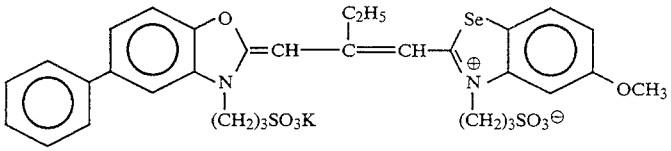

-continued
I-20
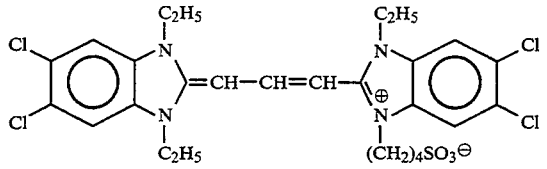
I-21
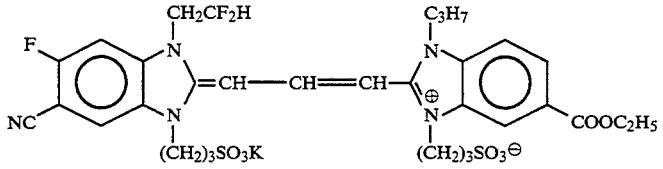
I-22
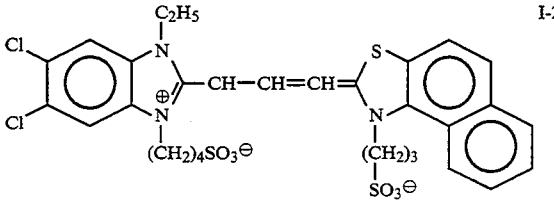
I-23
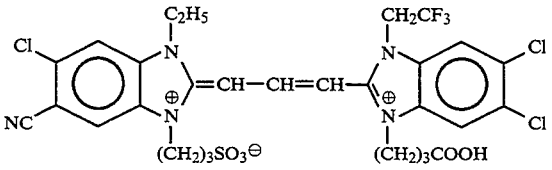
I-24
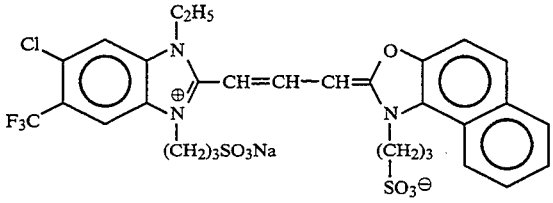
I-25
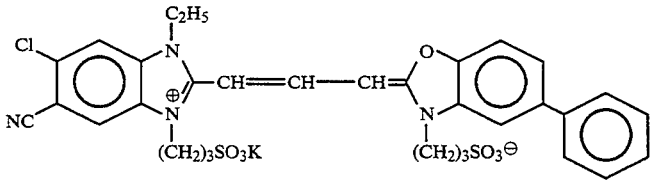
I-26
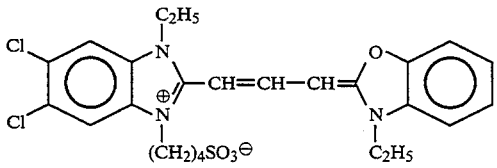
I-27
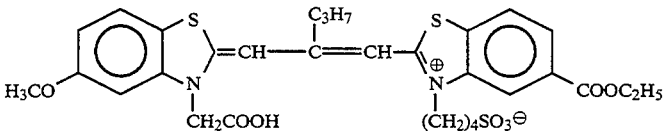
I-28
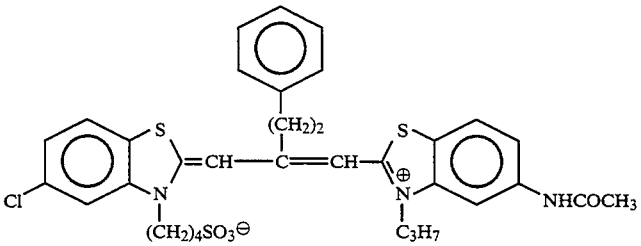

-continued
I-29
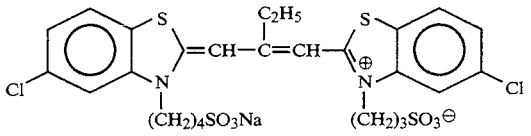
I-30
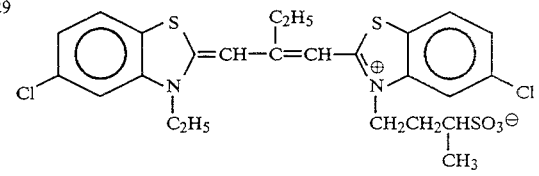
I-31
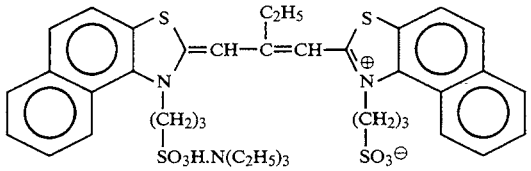
I-32
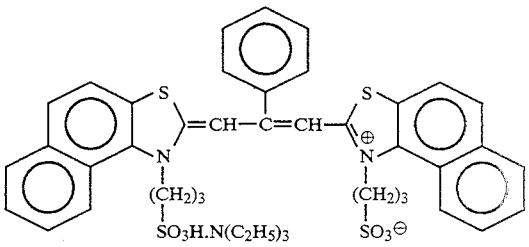
I-33
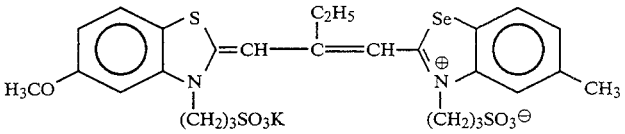
I-34
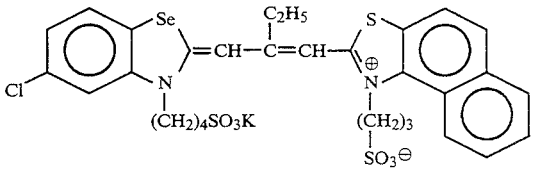
I-35
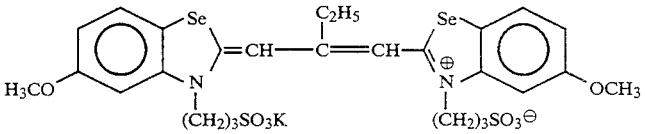
I-36
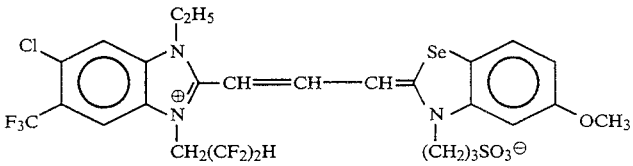
I-37
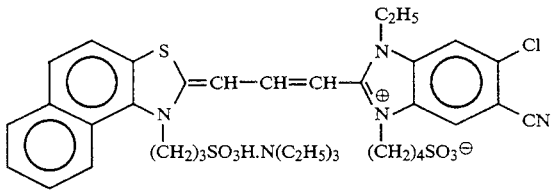
I-38
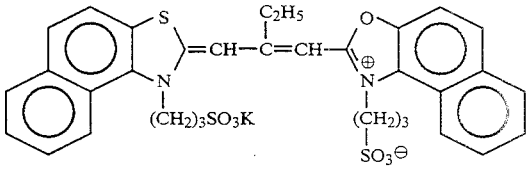
I-39
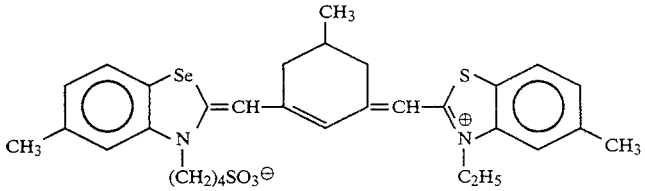

-continued
I-40
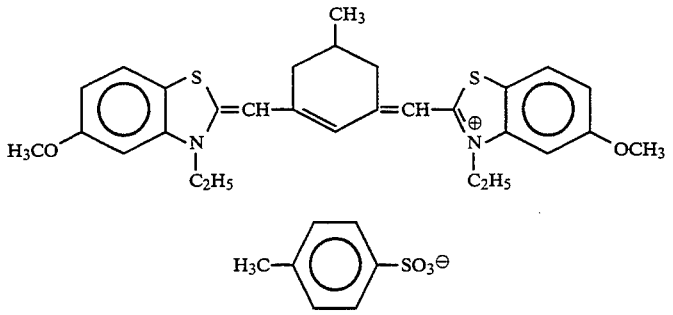
I-41
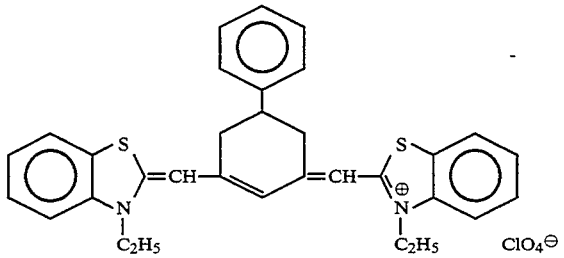
I-42
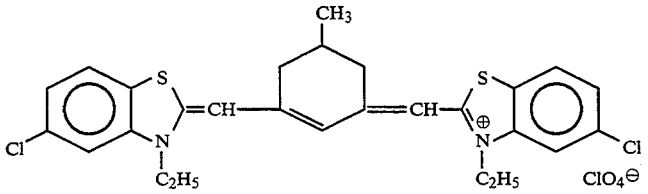
I-43
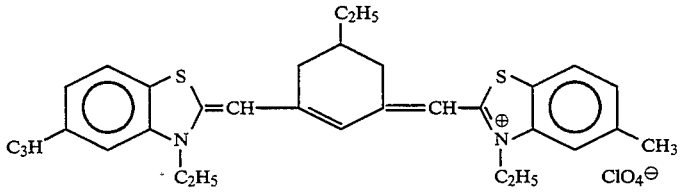
I-44
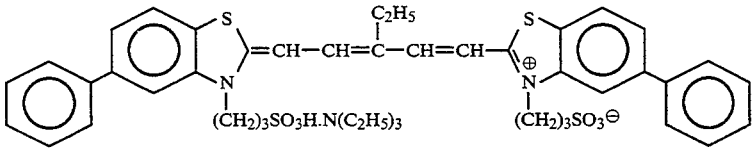
I-45
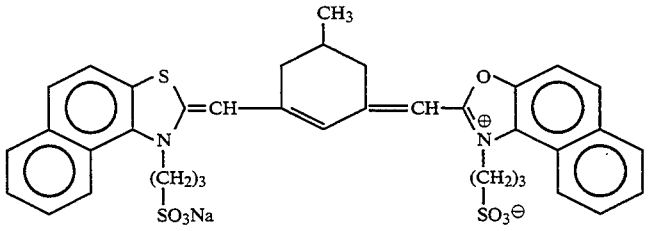
I-46
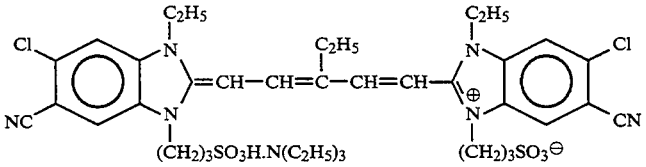

-continued

I-47

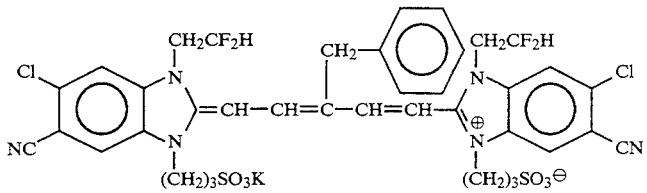

I-48

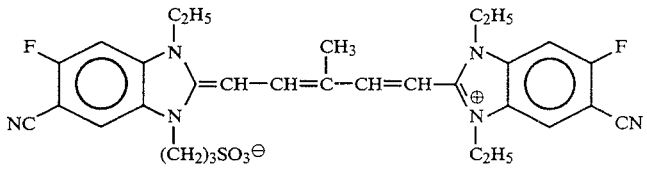

I-49

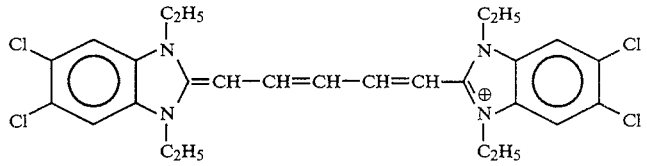

I-50

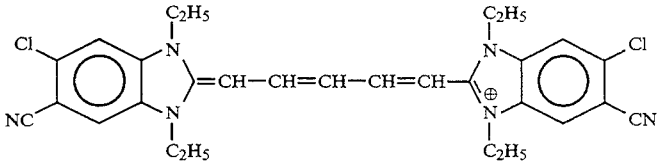

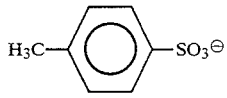

I-51

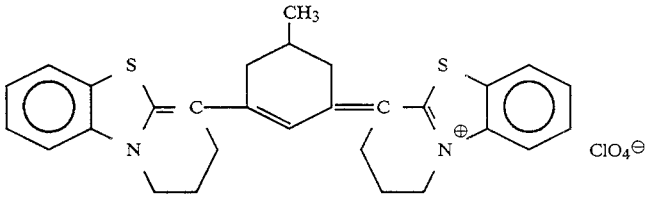

When the cyanine dyes represented by general formula (I) employed in the invention are allowed to be contained in the silver halide emulsions of the present invention, they may be directly dispersed in the emulsions, or may be dissolved in single or combined solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., followed by addition to the emulsions.

Further, there can also be used the method of dissolving a dye in an organic volatile solvent, dispersing the resulting solution in water or a hydrophilic colloid, and then adding the resulting dispersion to an emulsion, as described in U.S. Pat. No. 3,469,987; the method of dispersing a water-insoluble dye in a water-soluble solvent without dissolution, and then adding the resulting dispersion to an emulsion, as described in JP-B-46-24,185 (the term "JP-B" as used herein means an "examined Japanese patent publication"); the method of dissolving a dye in an acid, and then adding the resulting solution to an emulsion, or forming a solution in the coexistence of an acid or a base, and then adding the solution to an emulsion, as described in JP-B-44-23,389, JP-B-44-27,555 and JP-B-57-22,091; the method of forming a solution or a colloidal dispersion in the coexistence of an surface active agent, and then adding it to an emulsion, as described in U.S. Pat. Nos. 3,822,135 and 4,006,025; the method of directly dispersing a dye in a hydrophilic colloid, and then adding the resulting dispersion to an emulsion, as described in JP-A-53-102,733 and JP-A-58-105,141; and the method of dissolving a dye using a red shift-inducing compound, and then adding the resulting solution to an emulsion, as described in JP-A-51-74,624.

Furthermore, ultrasonics can also be used for dissolution.

The sensitizing dyes used in the present invention may be added to the emulsions at any stage of emulsion preparation which has hitherto been known to be useful. For example, they may be added at the stage of silver halide grain formation and/or prior to desalting, as disclosed in U.S. Pat. Nos. 2,735,766, 3,628,960, 4,183,756 and 4,225,666, JP-A-58-184,142 and JP-A-60-196,749; just before or during chemical ripening as disclosed in JP-A-58-113,920, and at any time and stage before emulsion coating, during the period between chemical ripening and coating. Further, as disclosed in U.S. Pat. No. 4,225,666 and JP-A-58-7,629, a single compound may be added alone, or combined compounds having different kinds of structures may be separately added, for example, during the stage of grain formation and during the stage of chemical ripening or after completion of chemical ripening, or before or during chemical ripening and after completion of chemical ripening. The compounds separately added and combinations thereof may be varied.

The sensitizing dyes represented by general formula (I) employed in the present invention can be added in an amount of $4\times10^{-6}$ to $8\times10^{-3}$ mol per mol of silver halide, although the amount added varies according to the shape and size of silver halide grains. For example, when the size of the silver halide grains ranges from 0.2 to 1.3 μm, the amount added is preferably from $5\times10^{-5}$ to $2\times10^{-3}$ mol per mol of silver halide and an amount corresponding to a grain surface covering ratio of 20 to 100%, more preferably 30 to 90% as well.

The silver halide emulsion of the present invention may contain a methine dye other than the cyanine dye according to the invention and/or a supersensitizing agent for expansion of a photosensitive wavelength region and supersensitization. When silver halide grains other than the silver halide grains according to the present invention are contained in the same layer or in a different layer, the silver halide grains may be spectrally sensitized with another methine dye and a supersensitizing agent, as well as the cyanine dye according to the present invention.

Examples of the dyes used include cyanine dyes, merocyanine dyes, complex cyanine dyes, complex merocyanine dyes, holopolar cyanine dyes, hemicyanine dyes, styryl dyes and hemioxonol dyes. Dyes belong to cyanine, merocyanine and complex merocyanine dyes are particularly useful. Any nuclei usually used for cyanine dyes as basic heterocyclic nuclei may be applied to these dyes. That is, the nuclei which can be applied include pyrroline, oxazoline, thiazoline, selenazoline, pyrrole, oxazole, thiazole, selenazole, imidazole, tetrazole, pyridine and tellurazole nuclei; nuclei formed by condensing alicyclic hydrocarbon rings with these nuclei; and nuclei formed by condensing aromatic hydrocarbon rings with these nuclei, that is, indolenine, benzindolenine, indole, benzoxazole, naphthoxazole, benzimidazole naphthimidazole, benzothiazole, naphthothiazole, benzoselenazole, naphthoselenazole, quinoline and benzotellurazole nuclei. These heterocyclic nuclei may be substituted on carbon atoms.

Any nuclei usually used for merocyanine dyes may be applied to the merocyanine or complex merocyanine dyes as nuclei having the ketomethylene structure. As particularly useful nuclei, 5-membered and 6-membered heterocyclic nuclei such as pyrazolin-5-one, thiohydantoin, 2-thioxazolidin-2,4-dione, thiazolidin-2,4-dione, rhodanine, thiobarbituric acid and 2-thioselenazolidin-2,4-dione nuclei can be applied.

These sensitizing agents may be used alone or in combination. The combinations of the sensitizing agents are frequently used, particularly for supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862 and 4,026,707, British Patents 1,344,281 and 1,507,803, JP-B-43-4,936, JP-B-53-12,375, JP-A-52-110,618 and JP-A-52-109,925.

Typical examples of the supersensitizing agents include bispyridinium salt compounds described in JP-A-59-142,541, etc., stilbene derivatives described in JP-B-59-18,691, etc., water-soluble bromides disclosed in JP-B-49-46,932, etc., condensed products between aromatic compounds and formaldehyde disclosed in U.S. Pat. No. 3,743,510, etc., cadmium salts and azaindene compounds.

These methine dyes may be added to the silver halide emulsions at any stage during preparation of the emulsions which has hitherto been recognized as useful. Methods for addition and the amounts to be added also may be any which have hitherto been known as useful. Concretely, the times of addition, the methods of addition and the amounts to be added include the same times, methods and amounts as described for the above-described cyanine dyes represented by general formula (I)

Compounds represented by general formula (II) will be illustrated below in detail.

Heterocycles formed by Q include, for example, imidazole, tetrazole, thiazole, oxazole, selenazole, benzimidazole, naphthoimidazole, benzothiazole, naphthothiazole, benzoselenazole, naphthoselenazole and benzoxazole.

Cations represented by M include, for example, a hydrogen ion, alkali metals (for example, sodium and potassium) and an ammonium ion.

As the compounds represented by general formula (II), mercapto compounds represented by the following general formulas (II-1), (II-2), (II-3) and (II-4), respectively, are preferable.

General formula (II-1)

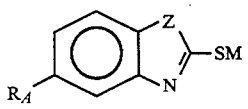

wherein $R_A$ represents a-hydrogen atom, an alkyl group, an alkoxyl group, an aryl group, a halogen atom, a carboxyl group or a salt thereof, a sulfo group or a salt thereof, or an amino group; Z represents —NH—, —O— or —S—; and M has the same meaning as M defined in general formula (II).

General formula (II-2)

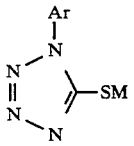

wherein Ar represents:

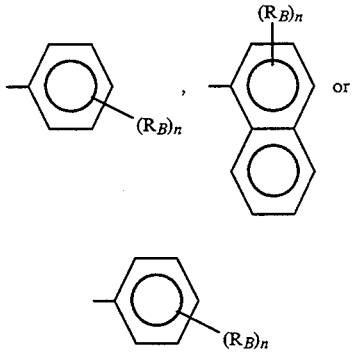

wherein $R_B$ represents an alkyl group, an alkoxyl group, a carboxyl group or a salt thereof, a sulfo group or a salt thereof, a hydroxyl group, an amino group, an acylamino group, a carbamoyl group or a sulfonamido group; n represents an integer of 0 to 2; and M has the same meaning as M defined in general formula (II).

In general formulas (II-1) and (II-2), the alkyl groups represented by $R_A$ and $R_B$ includes, for example, methyl, ethyl and butyl group. The alkoxyl group includes, for example, methoxy and ethoxy, and the salts of the carboxyl group or the sulfo group include, for example, sodium and ammonium salts.

In general formula (II-1), the aryl groups represented by $R_A$ include, for example, phenyl and naphthyl, and the halogen atoms include chlorine and bromine atoms.

In general formula (II-2), the acylamino groups represented by $R_B$ include, for example, methylcarbonylamino and benzoylamino; the carbamoyl groups include, for example, ethylcarbamoyl and phenylcarbamoyl; and the sulfonamido groups include, for example, methylsulfonamido and phenylsulfonamido.

The above-mentioned alkyl, alkoxyl, aryl, amino, acylamino, carbamoyl and sulfonamido groups may have further substituents. Taking the amino group as an example, the substituents include an amino group having an alkylcarbamoyl group as a substituent, i.e., an alkyl-substituted ureido group.

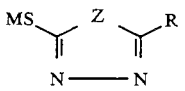

General formula (II-3)

wherein Z represents —N($R_{A1}$)—, an oxygen atom or a sulfur atom; R represents a hydrogen atom, an alkyl group, an aryl group, an alkenyl group, a cycloalkyl group, —$SR_{A1}$, —N($R_{A2}$)$R_{A3}$, —NHCO$R_{A4}$, —NH-$SO_2R_{A5}$ or a heterocyclic group wherein $R_{A1}$ represents a hydrogen atom, an alkyl group, an alkenyl group, a cycloalkyl group, an aryl group, —CO$RA_{A4}$ or —$SO_2$-$R_{A5}$, $R_{A2}$ and $R_{A3}$ represent hydrogen atoms, alkyl groups or aryl groups, and $R_{A4}$ and $R_{A5}$ represent alkyl groups or aryl groups; and M has the same meaning as M defined in general formula (II).

The alkyl groups represented by R, $R_{A1}$, $R_{A2}$, $R_{A3}$, $R_{A4}$ and $R_{A5}$ in general formula (II-3) include, for example, methyl, benzyl, ethyl and propyl, and the aryl groups include phenyl and naphthyl.

Examples of the alkenyl groups represented by R and $R_{A1}$ include propenyl, and examples of the cycloalkyl groups include cyclohexyl. Further, the heterocyclic groups represented by R include, for example, furyl and pyridinyl.

The alkyl and aryl groups represented by R, $R_{A1}$, $R_{A2}$, $R_{A3}$, $R_{A4}$ and $R_{A5}$, the alkenyl and cycloalkyl groups represented by R and $R_{A1}$, and the heterocyclic groups represented by R may have further substituents.

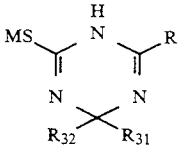

General formula (II-4)

wherein R and M each has the same meaning as R and M defined in general formula (II-3); and $R_{B1}$ and $R_{B2}$ each has the same meaning as $R_{A1}$ and $R_{A2}$ defined in general formula (II-3).

Examples of the compounds represented by general formula (II) are enumerated below, but the present invention is not limited thereto.

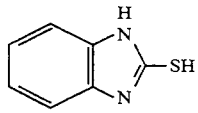

II-1-1

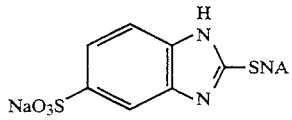

II-1-2

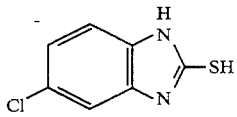

II-1-3

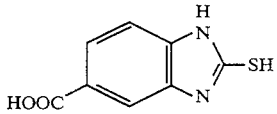

II-1-4

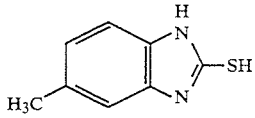

II-1-5

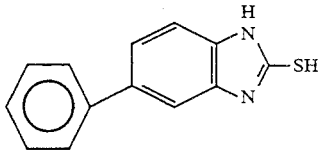

II-1-6

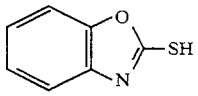

II-1-7

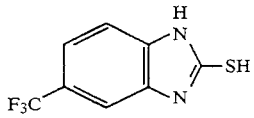

II-1-8

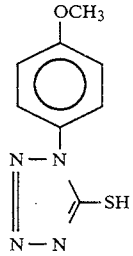

II-2-1

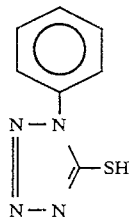

II-2-2

-continued
II-2-3
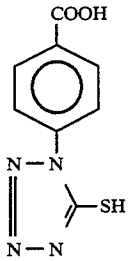
II-2-4
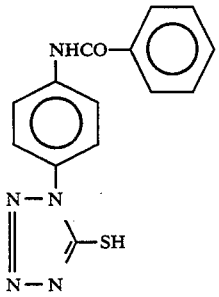
-continued
II-2-5
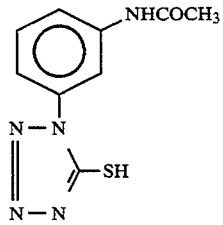
II-2-6
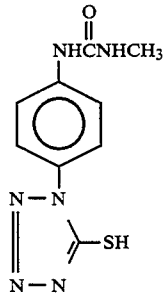
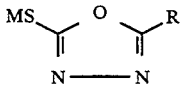
| Example Compound | R | M |
|---|---|---|
| II-3-1 | $-C_2H_5$ | —H |
| II-3-2 | $-CH_2-CH-CH_2$ | —H |
| II-3-3 | $-CH=CH-CH_2-CH_3$ | —H |
| II-3-4 | $-C_7H_{15}$ | —H |
| II-3-5 | $-C_9H_{19}$ | —Na |
| II-3-6 | 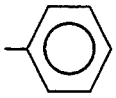 | —H |
| II-3-7 | $-C_4H_9(t)$ | —H |
| II-3-8 | 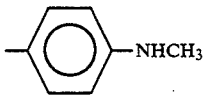 | —H |
| II-3-9 | 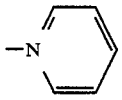 | —H |
| II-3-10 | 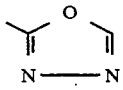 | —H |
| II-3-11 | 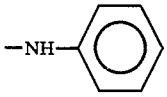 | —H |
| II-3-12 | 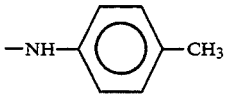 | $-NH_4$ |
| II-3-13 | $-NHCOCH_3$ | —H |

-continued
| | | |
|---|---|---|
| II-3-14 | 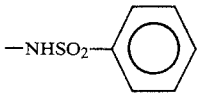 | —H |
| II-3-15 | $-N(CH_3)_3$ | —H |
| II-3-16 | 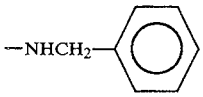 | —H |
| II-3-17 | 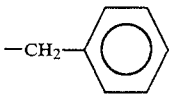 | —H |
| II-3-18 | $-S-CH_3$ | —H |
| II-3-19 | 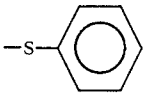 | —H |
| II-3-20 | —SH | —H |
| II-3-21 | —H | —H |
| II-3-22 | $-C_2H_5$ | —H |
| II-3-23 | $-C_4H_9(t)$ | —H |
| II-3-24 | $-C_6H_{13}$ | —H |
| II-3-25 | 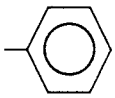 | —H |
| II-3-26 | 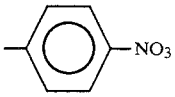 | —H |
| II-3-27 | 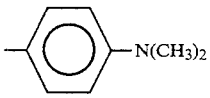 | —H |
| II-3-28 | 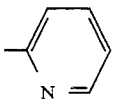 | —H |
| II-3-29 | 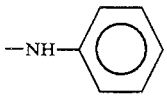 | —H |
| II-3-30 | $-NH_2$ | —H |
| II-3-31 | $-CH_2CH=CH_2$ | —H |
| II-3-32 | —SH | —H |
| II-3-33 | $-NHCOC_2H_5$ | —H |
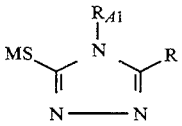
| Example Compound | R | $R_{A1}$ | M |
|---|---|---|---|
| II-3-34 | $-C_2H_5$ | —H | —H |
| II-3-35 | $-CH_3$ | $-CH_3$ | —H |

-continued
| | | | |
|---|---|---|---|
| II-3-36 | $-CH_3$ | 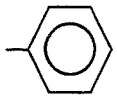 | $-H$ |
| II-3-37 | $-NHCOCH_3$ | $-CH_3$ | $-H$ |
| II-3-38 | 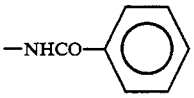 | 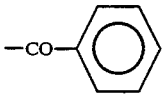 | $-H$ |
| II-3-39 | $-NHCOCH_3$ | $-COCH_3$ | $-H$ |
| II-3-40 | $-NHCOCH_3$ | 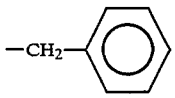 | $-H$ |
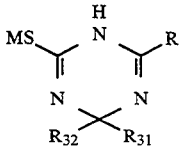
| Example Compound | R | $R_{31}$ | $R_{32}$ | M |
|---|---|---|---|---|
| II-4-1 | $-C_2H_5$ | $-CH_3$ | $-CH_3$ | $-H$ |
| II-4-2 | 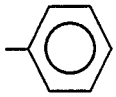 | $-CH_3$ | $-CH_3$ | $-H$ |
| II-4-3 | $-NH_2$ | $-H$ | 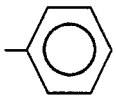 | $-H$ |
| II-4-4 | 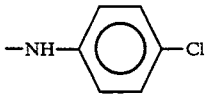 | $-CH_3$ | $-C_4H_9$ | $-H$ |
| II-4-5 | $-NHCOCH_3$ | $-CH_3$ | $-CH_3$ | $-H$ |
| II-4-6 | 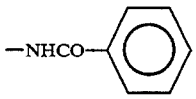 | $-CH_3$ | $-CH_3$ | $-H$ |
| II-4-7 | 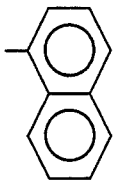 | $-CH_3$ | $-C_3H_7(i)$ | $-H$ |
| II-4-8 | 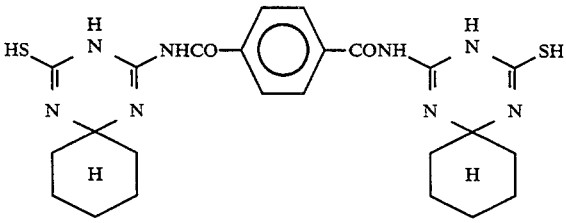 | | | |

The compounds represented by general formula (II) are added preferably in an amount of $1\times10^{-4}$ to $1\times10^{-2}$ mol per mol of silver halide. There is no particular-limitation on methods for addition, and the compounds may be added during any stage of silver halide grain formation, physical ripening, chemical ripening and preparation of coating solutions.

For the purpose of preventing fogging during manufacturing stages, storage or photographic processing of the photographic materials or stabilizing photographic properties thereof, various compounds or their precursors may be added to the silver halide emulsions used in the present invention. Examples of these compounds which are preferably used are described on pages 39 to 48 of JP-A-62-215272 described above.

The emulsions used in the present invention may be either so-called surface latent image type emulsions in which latent images are mainly formed on the surfaces of grains or so-called internal latent image type emulsions in which latent images are mainly formed in the insides of grains.

In the photographic materials according to the present invention, it is preferred that dyes decolorizable by processing (oxonol dyes among others) described in European Patent (EPO) 0,337,490A2, pages 27 to 76 are added to hydrophilic colloidal layers so that the optical reflection density of the photographic materials at 680 nm reaches 0.70 or more, or that 12% by weight or more (more preferably 14% by weight or more) of titanium oxide surface-treated with dihydric to tetrahydric alcohols (for example, trimethylolethane) is added to water-resistant resin layers of supports, for the purpose of improving the sharpness of images.

High boiling organic solvents for photographic additives such As cyan, magenta and yellow couplers usable in the present invention can be used as long as they are water-immiscible compounds which have a melting point of 100° C. or less and a boiling point of 140° C. or more, and which are good solvents for the couplers. The melting point of the high boiling organic solvents is preferably 80° C. or less. The boiling point of the high boiling organic solvents preferably 160° C. or more, and more preferably 170° C. or more.

Details of these high boiling organic solvents are described in JP-A-62-215272, page 137, lower right column to page 144, upper right column.

The cyan, magenta or yellow couplers are preferably impregnated with loadable latex polymers (for example, U.S. Pat. No. 4,203,716) in the presence or in the absence of the boiling organic solvents described above, or dissolved together with water-insoluble, organic solvent-soluble polymers to emulsify them in aqueous solutions of hydrophilic colloids.

Homopolymers or copolymers described in U.S. Pat. No. 4,857,449 and PCT International Publication No. WO88/00723, pages 12 to 30 are preferably used. More preferably, the use of methacrylate or acrylamide polymers, particularly the use of the acrylamide polymers, is preferable in respect to image stabilization.

In the photographic materials of the present invention, compounds for improving the keeping quality of color images as. described in European Patent (EP) 0,277,589A2 are preferably used in combination with the couplers. In particular, they are preferably used in combination with pyrazoloazole couplers or pyrrolotriazole couplers.

Namely, in order to prevent the production of stains, for example, due to formation of forming dyes caused by reaction of color developing agents remaining in films or oxidation products thereof with couplers during storage after processing, and other side effects, it is preferred to use the compounds described in the above-described patent specifications which are chemically bonded to aromatic amine developing agents remaining after color development to form chemically inactive, substantially colorless compounds and/or the compounds described in the above-described patent specifications which are chemically bonded to oxidation products of the aromatic amine color developing agents remaining after color development to form chemically inactive, substantially colorless compounds, alone or in combination.

The cyan couplers preferably used include 3-hydroxypyridine cyan couplers described in European Patent (EP) 0,333,185A2 (a coupler obtained by giving a chlorine elminable group to a 4-equivalent coupler of coupler (42) concretely enumerated to form a 2-equivalent coupler, and couplers (6) and (9) are particularly preferred among others), cyclic active. methylene cyan couplers described in JP-A-64-32260 (couplers 3, 8 and 34 concretely enumerated are particularly preferred among others), pyrrolopyrazole cyan couplers described in European Patent (EP) 456,226A1, pyrroloimidazole cyan couplers described in European Patent (EP) 0,484,909, and pyrrolotriazole cyan couplers described in European Patents (EP) 0,488,248 and 0,491,197A1, as well as diphenylimidazole cyan couplers described in JP-A-2-33144. The use of the pyrrolotriazole cyan couplers is particularly preferred among others.

The yellow couplers preferably used include acylacetamide yellow couplers described in European Patent (EP) 0,447,969A1 in which acyl groups have 3-membered to 5-membered cyclic structures, malondianilide yellow couplers having cyclic structures described in European Patent (EP) 0,482,552A1 and acylacetamide yellow couplers having dioxane structures described in U.S. Pat. No. 5,118,599, as well as the compounds described in the tables shown below. Of these, the acylacetamide yellow couplers in which the acyl groups are 1-alkylcyclopropane-1-carbonyl, and the malondianilide yellow couplers in each of which one of the anilides constitutes an indoline ring are preferably used. These couplers can be used alone or in combination.

The magenta couplers used in the present invention include 5-pyrazolone magenta couplers and pyrazoloazole magenta couplers as described in the literatures shown in the tables described below. In respect to hue, image stability and color forming property, the magenta couplers preferably used include pyrazolotriazole couplers as described in JP-A-61-65245 in each of which a secondary or tertiary alkyl group is directly bonded to the 2-, 3- or 6-position of a pyrazolotriazole ring, pyrazoloazole couplers as described in JP-A-61-65246 in each of which a sulfonamido group is contained in the molecule, pyrazoloazole couplers each having an alkoxyphenylsulfonamidobalast group as described in JP-A-61-147254 and pyrazoloazole couplers each having an alkoxyl group or an aryloxy group at the 6-position as described in European Patents 226,849A and 294,785A.

As methods for processing the color photographic materials of the present invention, the processing materials and the processing methods described in JP-A-2-207250, page 26, lower right column, line 1 to page 34, upper right column, line 9 and JP-A-4-97355, page 5, upper left column, line 17 to page 18, lower right column, line 20, in addition to the methods described in the tables shown below, are preferably used.

Further, in the photographic materials of the present invention, antifungal agents as described in JP-A-63-271247 are preferably added, in order to prevent various molds and bacteria which propagate in hydrophilic colloidal layers to deteriorate images.

White polyester supports or supports provided with white pigment-containing layers on the sides coated with silver halide emulsion layers may be used for displays as supports used in the photographic materials of the present invention. Furthermore, in order to improve the sharpness, an antihalation layers are preferably formed on the sides coated with silver halide emulsion layers or on the back surfaces of the supports. In particular, it is preferred that the transmission density is established within the range of 0.35 to 0.8 so that the displays can be appreciated with both reflected light and transmitted light.

The photographic materials according to the present invention may be exposed to visible light or infrared light. Exposing methods may be either low illuminance exposure or high illumination-short time exposure, and particularly, in the latter case, laser scanning exposing methods in which the exposing time is shorter than $10^{-4}$ second per pixel.

In exposing, the band stop filter described in U.S. Pat. No. 4,880,726 is preferably used, whereby optical color mixing is eliminated and color reproducibility is markedly improved.

The exposed photographic materials are preferably subjected to bleaching-fixing after color development for rapid processing. In particular, when the above-described high silver chloride emulsions are used, the pH of bleaching-fixing solutions is preferably about 6.5 or less, and more preferably about 6 or less for the purpose of enhancing desilverization.

The silver halide emulsions, other materials (such as additives) and photographic constituent layers (such as layer arrangement) applied to the photographic materials of the present invention, and processing methods and additives for processing applied to treat the photographic materials, which are preferably used, are described in the following patents, particularly in European Patent (EP) 0,355,660A2 (JP-A-2-139544).

| Photographic Constituents, etc. | JP-A-62-215272 | JP-A-2-33144 | EP0,355,660A2 |
|---|---|---|---|
| Silver Halide Emulsions | Page 10, upper right column, line 6 to page 12, lower left column, line 5; page 12, lower right column, line 4 from the bottom to page 13, upper left column, line 17 | Page 28, upper right column, line 16 to page 29, lower right column, line 11; page 30, line 2 to line 5 | Page 45, line 53 to page 47, line 3; page 47, line 20 to line 22 |
| Solvents for Silver Halides | Page 12, lower left column, line 6 to line 14; page 13, upper left column, line 3 from the bottom to page 18, lower left column, the last line | — | — |
| Chemical Sensitizers | Page 12, lower left column, line 3 from the bottom to lower right column, line 5 from the bottom; page 18, lower right column, line 1, to page 22, upper right column, line 9 from the bottom | Page 29, lower right column, line 12 to the last line | Page 47, line 4 to line 9 |
| Spectrally Sensitizing Agents (Spectrally Sensitizing Methods) | Page 22, upper right column, line 8 from the bottom to page 38, the last line | Page 30, upper left column, line 1 to line 13 | Page 47, line 10 to line 15 |
| Emulsion Stabilizers | Page 39, upper left column, line 1 to page 72, upper right column, the last line | Page 30, upper left column, line 14 to upper right column, line 1 | Page 47, line 16 to line 19 |
| Development Accelerators | Page 72, lower left column, line 1 to page 91, upper right column, line 3 | — | — |
| Color Couplers (Cyan, Magenta, Yellow Couplers) | Page 91, upper right column, line 4 to page 121, upper left column, line 6 | Page 3, upper right column, line 14 to page 1 upper left column, the last line; page 30, upper right column, line 6 to page 35, lower right column, line 11 | Page 4, line 15 to line 27; page 5, line 30 to page 28, the last line; page 45, line 29 to line 31; page 47, line 23 to page 63, line 50 |
| Color Development Increasing Agents | Page 121, upper left, column, line 7 to page 125, upper right column, line 1 | — | — |
| Ultraviolet Absorbers | Page 125, upper right column, line 2 to page | Page 37, lower right column, line 14 to | Page 65, line 22 to line 31 |

-continued

| Photographic Constituents, etc. | JP-A-62-215272 | JP-A-2-33144 | EP0,355,660A2 |
|---|---|---|---|
| | 127, lower left column, the last line | page 38, upper left column, line 11 | |
| Antifading Agents (Image Stabilizers) | Page 127, lower right column, line 1 to page 137, lower left column, line 8 | Page 36, upper right column, line 12 to page 37, upper left column, line 19 | Page 4, line 30 to page 5, line 23; page 29, line 1 to page 45, line 25; page 45, line 33 to line 40; page 65 line 2 to line 21 |
| High Boiling and/or Low Boiling Organic Solvents | Page 137, lower left column, line 9 to page 144, upper right column, the last line | Page 35 ,lower right column, line 14 to page 36, upper left column, line 4 from the bottom | Page 64, line 1 to line 51 |
| Dispersing Methods of Photographic Additives | Page 144, lower left column, line 1 to page 146, upper right column, line 7 | Page 27, lower right column, line 10 to page 28, upper left column, the last line; page 35, lower right column, line 12 to page 36, upper right column, line 7 | Page 63, line 51 to page 64, line 56 |
| Hardeners | Page 146, upper right column, line 8 to page 155, lower left column, line 4 | — | — |
| Developing Agent Precursors | Page 155, lower left column, line 5 to lower right column, line 2 | — | — |
| Development Restrainer-Releasing Compounds | Page 155, lower right column, line 3 to line 9 | — | — |
| Supports | Page 155, lower right column, line 19 to page 156, upper left column, line 14 | Page 38, upper right column, line 18 to page 39, upper left column, line 3 | Page 66, line 29 to page 67, line 13 |
| Photographic Material Layer Constitution | Page 156, upper left column, line 15 to page 156, lower right column, line 14 | Page 28, upper right column, line 1 to line 15 | Page 45, line 41 to line 52 |
| Dyes | Page 156, lower right column, line 15 to page 184, lower right column, the last line | Page 38, upper left column, line 12 to upper right column, line 7 | Page 66, line 18 to line 22 |
| Color Mixing Inhibitors | Page 185, upper left column, line 1 to lower right column, line 3 | Page 36, upper right column, line 8 to line 11 | Page 64, line 57 to page 65, line 1 |
| Gradation Modifiers | Page 188, lower right column, line 4 to line 8 | — | — |
| Stain Inhibitors | Page 188, lower right column, line 9 to page 193, lower right column, line 10 | Page 37, upper right column, the last line to lower, right column, line 13 | Page 65, line 32 to page 66, line 17 |
| Surfactants | Page 201, lower left column, line 1 to page 210, upper right column, the last line | Page 18, upper right column, line 1 to page 24, lower right column, the last line; page 27, lower left column, line 10 from the bottom to lower right column, line 9 | — |
| Fluorine-Containing Compounds (Antistatic Agents, Coating Aids, Lubricants, Adhesion Inhibitors) | Page 210, lower left column, line 1 to page 222, lower left column, line 5 | Page 25, upper left column, line 1 to page 27, lower right column, line 9 | — |
| Binders (Hydrophilic Colloids) | Page 222, lower left column, line 6 to page 225, upper left column, the last line | Page 38, upper right column, line 8 to line 18 | Page 66, line 23 to line 28 |
| Tackifiers | Page 225, upper right column, line 1 to page 227, upper right column, line 2 | — | — |
| Antistatic Agents | Page 227, upper right column, line 3 to page 230, upper left column, line 1 | — | — |
| Polymer Latices | Page 230, upper left | — | — |

-continued

| Photographic Constituents, etc. | JP-A-62-215272 | JP-A-2-33144 | EP0,355,660A2 |
|---|---|---|---|
| | column, line 2 to page 239, the last line | | |
| Matting Agents | Page 240, upper left column, line 1 to upper right column, the last line | — | — |
| Photographic Processing Methods (Processing Stages and Additives) | Page 3, upper right column, line 7 to page 10, upper right column, line 5 | Page 39, upper left column, line 4 to page 42, upper left column, the last line | Page 67, line 14 to page 69, line 28 |

Note:
The cited portions of JP-A-62-215272 include the contents of the amendment dated March 16, 1987 given in the end of this publication. Of the above-described color couplers, so-called short wave type yellow couplers described in JP-A-63-231451, JP-A-63-123047, JP-A-63-241547, JP-A-1-173499, JP-A-1-213648 and JP-A-1-250944 are also preferably used as yellow couplers.

EXAMPLES

Example 1

A paper support both sides of which were laminated with polyethylene was subjected to corona discharge treatment and then provided with a gelatin underlayer containing sodium dodecylbenzenesulfonate. Various photographic constituent layers were further formed thereon. Thus, a multilayer color photographic paper (sample 101) having the following layer constitution was prepared. The polyethylene layer on the surface of the paper support to which emulsions were applied contained 13% by weight of titanium dioxide and had a thickness of 30 μm. The coating solutions were prepared as follows:

Preparation of Coating Solution for First Layer 153.0 g of yellow coupler (ExY), 15.0 g of color image stabilizer (Cpd-1), 7.5 g of color image stabilizer (Cpd-2) and 16.0 g of color image stabilizer (Cpd-3) were dissolved in 180.0 cc of ethyl acetate, 25 g of solvent (Solv-1) and 25 g of solvent (Solv-2). The resulting solution was emulsified and dispersed in 1000 g of a 10% aqueous solution of gelatin containing 60 cc of 10% sodium dodecylbenzenesulfonate and 10 g of citric acid to prepare an emulsified dispersion A. On the other hand, silver chlorobromide emulsion A as shown in the following Table 1 was prepared.

The above-described emulsified dispersion A and this silver chlorobromide emulsion A were mixed with each other to prepare a coating solution for a first layer so as to give the composition shown below.

Coating solutions for second to seventh layers were also prepared similarly with the coating solution for the first layer. As a gelatin hardener for each layer, H-1 and H-2 were used.

Cpd-10 and Cpd-11 were added to each layer to total amounts of 25.0 mg/m$^2$ and 50.0 mg/m$^2$, respectively. In silver chlorobromide emulsions (Table 1) of respective light-sensitive emulsion layers, the following spectral sensitizing dyes were used, respectively.

Blue-Sensitive Emulsion Layer

Sensitizing Dye A

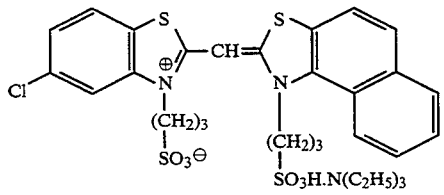

and

Sensitizing Dye B

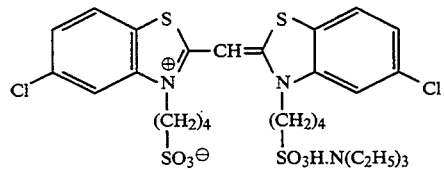

(each 2.0 × 10$^{-4}$ mol per mol of silver halide)

Green-Sensitive Emulsion Layer

Sensitizing Dye C

-continued

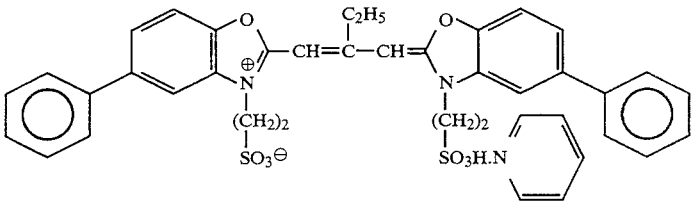

(4.0 × $10^{-4}$ mol per mol of silver halide)

and

Sensitizing Dye D

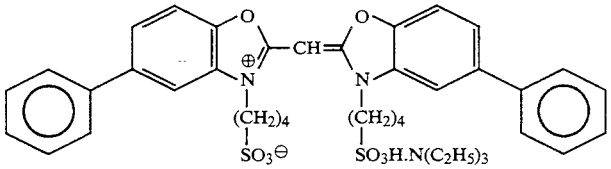

(7.0 × $10^{-5}$ mol per mol of silver halide)

Red-Sensitive Emulsion Layer

Sensitizing Dye E

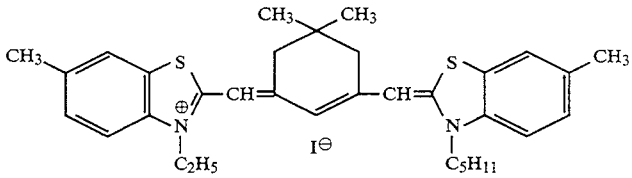

(0.9 × $10^{-4}$ mol per mol of silver halide)

The following compound was further added in an amount of $2.6\times10^{-3}$ mol per mol of silver halide:

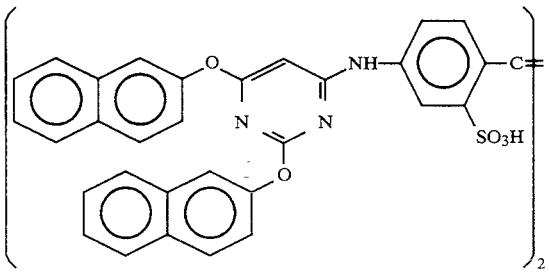

Further, compound II-2-6 represented by general formula [2] was added to the blue-sensitive emulsion layer (the first layer), the green-sensitive emulsion layer (the third layer) and the red-sensitive emulsion layer (the fifth layer) in amounts of $8.5\times10^{-5}$ mol and $2.5\times10^{-4}$ mol per mol of silver halide, respectively. The following dyes were added to the emulsion layers to prevent irradiation (the numerical values in parentheses indicate coated weights):

[KA 34]

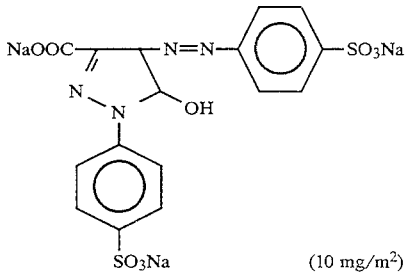

(10 mg/$m^2$)

-continued

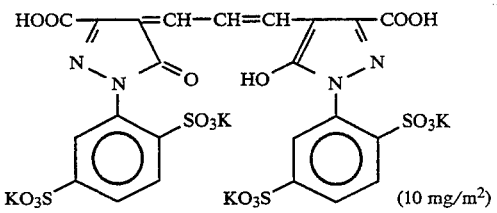

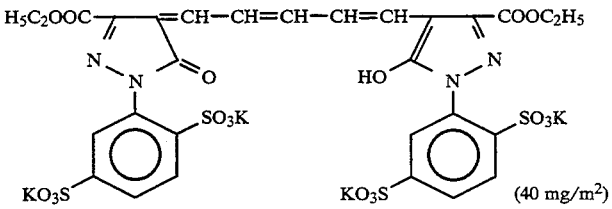

and

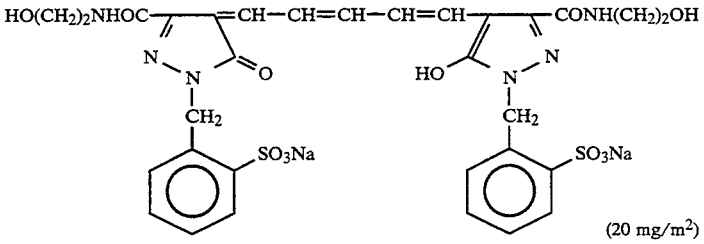

(Layer Construction)

The composition of each layer is hereinafter shown. The numerals indicate coated weights (g/m$^2$). For the silver halide emulsions, the numerals indicate coated weights converted to silver.

Support

Paper laminated with polyethylene

[Polyethylene on the side of the first layer contains a white pigment ($TiO_2$) and a bluing dye (ultramarine)]

| | |
|---|---|
| First Layer (Blue-Sensitive Emulsion Layer) | |
| Silver Chlorobromide Emulsion A | 0.26 |
| Gelatin | 1.52 |
| Yellow Coupler (ExY) | 0.48 |
| Solvent (Solv-3) | 0.18 |
| Solvent (Solv-6) | 0.18 |
| Color Image Stabilizer (Cpd-1) | 0.15 |
| Color Image Stabilizer (Cpd-9) | 0.04 |
| Stabilizer (Cpd-12) | 0.01 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Emulsion Layer) | |
| Silver Chlorobromide Emulsion B1 | 0.12 |
| Gelatin | 1.24 |
| Magenta Coupler (ExM) | 0.16 |
| Color Image Stabilizer (Cpd-2) | 0.03 |
| Color Image Stabilizer (Cpd-3) | 0.16 |
| Color Image Stabilizer (Cpd-4) | 0.02 |

-continued

| | |
|---|---|
| Color Image Stabilizer (Cpd-9) | 0.02 |
| Solvent (Solv-2) | 0.80 |
| Fourth Layer ((Ultraviolet Light Absorbing Layer) | |
| Gelatin | 1.58 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-Sensitive Emulsion Layer) | |
| Silver Chlorobromide Emulsion B1 | 0.20 |
| Gelatin | 0.80 |
| Cyan Coupler (ExC) | 0.25 |
| Color Image Stabilizer (Cpd-2) | 0.01 |
| Color Image Stabilizer (Cpd-4) | 0.01 |
| Color Image Stabilizer (Cpd-6) | 0.08 |
| Color Image Stabilizer (Cpd-7) | 0.18 |
| Color Image Stabilizer (Cpd-8) | 0.02 |
| Solvent (Solv-4) | 0.14 |
| Sixth Layer (Ultraviolet Light Absorbing Layer) | |
| Gelatin | 1.06 |
| Ultraviolet Light Absorber (UV-1) | 0.32 |
| Color Image Stabilizer (Cpd-3) | 0.04 |
| Color Image Stabilizer (Cpd-13) | 0.15 |
| Solvent (Solv-5) | 0.32 |
| Seventh Layer (Protective Layer) | |
| Gelatin | 1.33 |
| Acrylic modified Copolymer of Polyvinyl Alcohol (degree of modification: 17%) | 0.17 |
| Liquid paraffin | 0.03 |

(ExY) Yellow Coupler

A 1:1 mixture (molar ratio) of

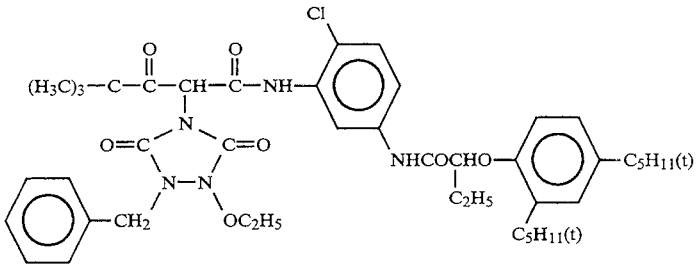
and
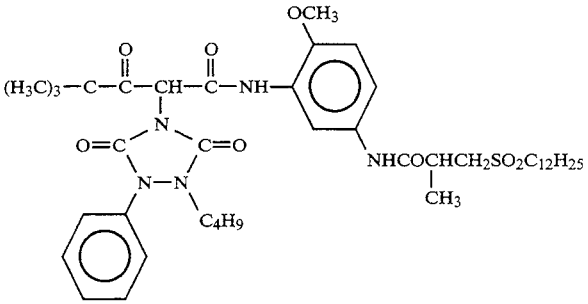
(ExM) Magenta Coupler
A 1:1 mixture (molar ratio) of
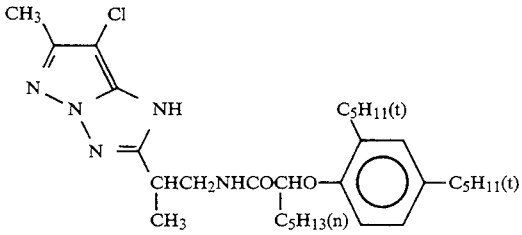
and
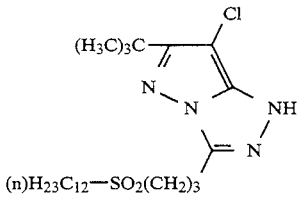
(ExC) Cyan Coupler
A 1:1 mixture (molar ratio) of
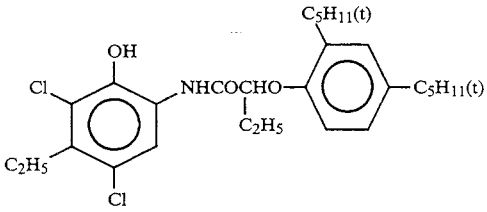
and
-continued
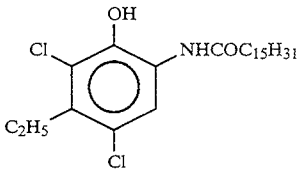
(Cpd-1) Color Image Stablizer
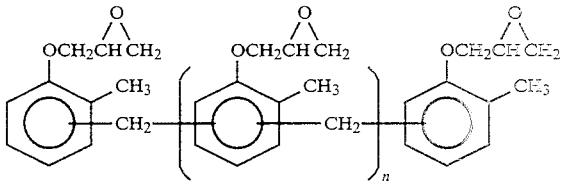
(Cpd-2) Color Image Stablizer
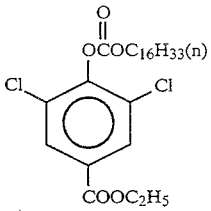
(Cpd-3) Color Image Stablizer
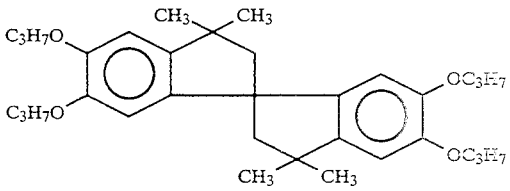

(Cpd-4) Color Image Stablizer
A 1:1 mixture (molar ratio) of
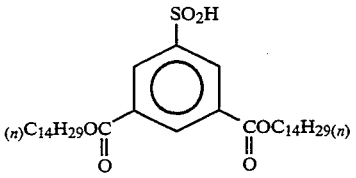
and
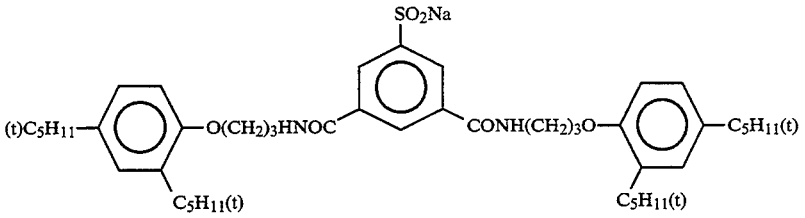
(Cpd-5) Color Mixing Inhibitor
A 1:1 mixture (weight ratio) of (1) and (2)
(1)
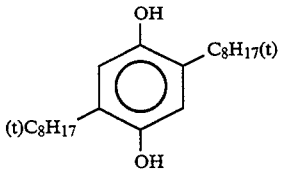
(2)
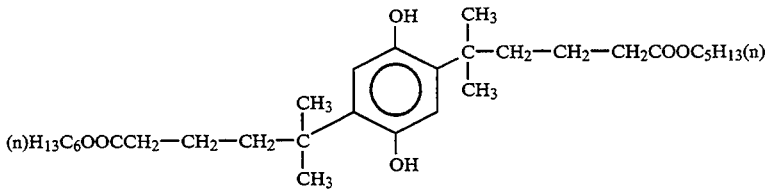
(Cpd-6) Color Image Stablizer
A 2:4:4 mixture of (i), (ii) and (iii)
(i)
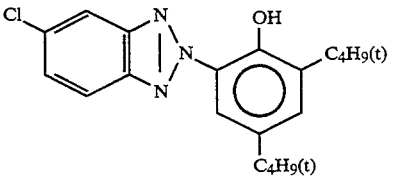
(ii)
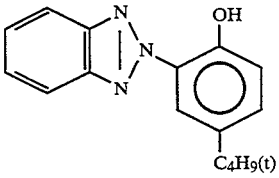
(iii)
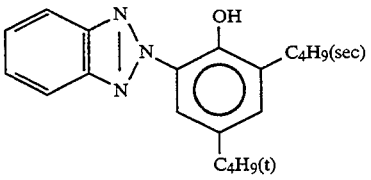
(Cpd-7) Color Image Stablizer
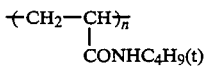
(average molecular weight: 60,000)
(Cpd-8) Color Image Stablizer
A 1:1 mixture (weight ratio) of
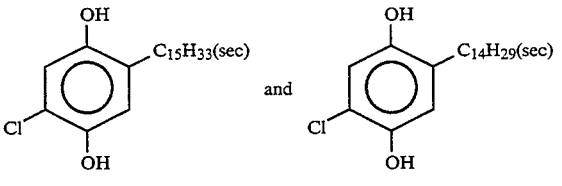
(Cpd-9) Color Image Stablizer
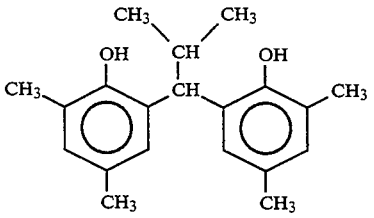
(Cpd-10) Preservative

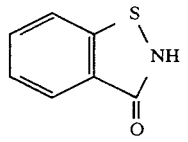

(Cdp-11) Preservative

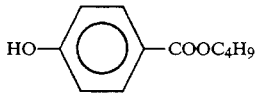

(Cpd-12) Stablizer

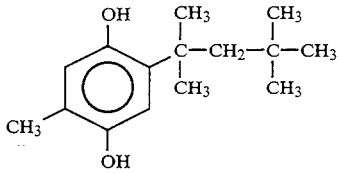

(Cpd-13) Color Image Stablizer

Methyl methacrylate-styrene copolymer (molar ratio: 50:50) (average molecular weight: about 60,000)

(UV-1) Ultraviolet Light Absorber

A 5:2:1:2 mixture (weight ratio of (iv) (v) (vi) and (vii)

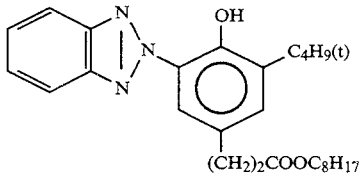

(iv)

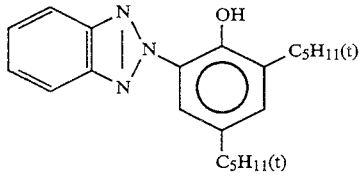

(v)

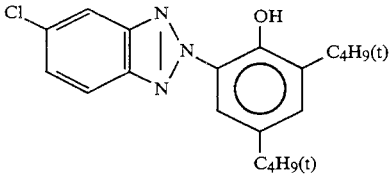

(vi)

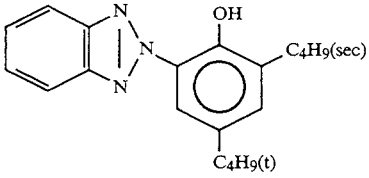

(vii)

-continued

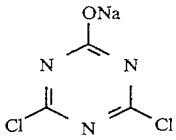

(H-1)

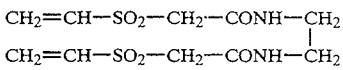

(H-2)

[KA 41]

(Solv-1) Solvent

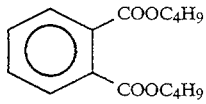

(Solv-2) Solvent

A 1:1 mixture of

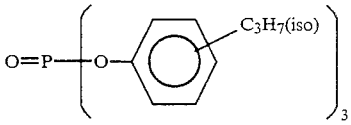

and

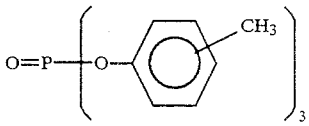

(Solv-3) Solvent

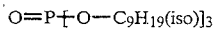

(Solv-4) Solvent

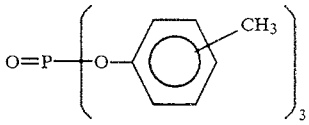

(Solv-5) Solvent

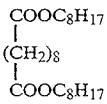

(Solv-6) Solvent

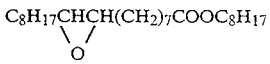

The emulsions used in the present invention were prepared in the following manner. The mean volume of the emulsion grains was measured with a Coulter counter (manufactured by Coulter). The mean surface area per emulsion grain and the mean ratio of the area of the (100) planes to the whole surface area of the emulsion grains were determined by electron photomicrographs according to the method described in this specification.

(Preparation of Silver Chlorobromide Emulsion A)

To 1,600 cc of a 3% aqueous solution of gelatin treated with lime, 17.6 g of sodium chloride was added, and the resulting aqueous solution was heated to 75° C. An aqueous solution containing 0.094 mol of silver nitrate and an aqueous solution containing 0.12 mol of sodium chloride were added to the solution maintained at that temperature with vigorous stirring. Subsequently, an aqueous solution containing 0.85 mol of silver nitrate and an aqueous solution containing 1.15 mol of sodium chloride were added.

Then, the temperature was lowered to 40° C., and desilverizaion was carried out by sedimentation washing, followed by addition of 90.0 g of lime-treated gelatin to dissolve it. To the resulting emulsion, 0.005 mol of an emulsion of fine silver bromide grains having a side length o#0.05 μm was added at 50° C., and then a sulfur sensitizing agent and a gold sensitizing agent were added to conduct ripening, thereby achieving optimal sensitization.

(Preparation of Silver Chlorobromide Emulsion B-1)

Optimal sensitization was conducted in accordance with the preparation method of silver chlorobromide emulsion A, with the exception that the temperature of the aqueous solution obtained by adding 17.6 g of sodium chloride to 1,600 cc of the 3% aqueous solution of gelatin treated with lime was changed to 58° C.

(Preparation of Silver Chlorobromide Emulsion B-2)

To 1,600 cc of a 3% aqueous solution of gelatin treated with lime, 17.6 g of sodium chloride and 0.63 g of the following compound (A) were added, and the resulting aqueous solution was heated to 58° C. An aqueous solution containing 0.094 mol of silver nitrate and an aqueous solution containing 0.12 mol of sodium chloride were added to the solution maintained at that temperature with vigorous stirring. Subsequently, an aqueous solution containing 0.85 mol of silver nitrate and an aqueous solution containing 1.15 mol of sodium chloride were added. Except for that, optimal sensitization was conducted in accordance with the preparation method of silver chlorobromide emulsion B1 to prepare silver chlorobromide emulsion B2 comprising tabular grains having a mean aspect ratio of 5.2.

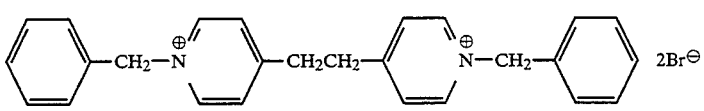

(A)

(Preparation of Silver Chlorobromide Emulsions B-3 to B-5)

Emulsions B-3 and B-4 were prepared by the same emulsion preparing method as with B-2, with the exception that the amount of the silver bromide fine grain emulsion added on sensitization was changed. Emulsion B-5 was prepared by optimal sensitization without addition of the silver bromide fine grain emulsion.

(Preparation of Silver Chlorobromide Emulsion B-6)

An aqueous solution of gelatin (containing 1,200 cc of $H_2O$, 6 g of empty gelatin and 0.5 g of NaCl, pH 9.0) was placed in a reaction vessel, and the temperature was elevated to 65° C. An aqueous solution containing 0.1 g/cc of $AgNO_3$ and an aqueous solution containing 0.0345 g/cc of NaCl were concurrently added and mixed at 15 cc/minute for 6 minutes with stirring. Then, a gelatin solution (containing 100 cc of $H_2O$, 19 g of empty gelatin and 1.3 g of NaCl) was added, and a 1N $HNO_3$ solution was added to adjust the resulting solution to pH 4.0. Subsequently, the temperature was raised to 70° C., and ripening was carried out for 16 minutes, followed by addition of 0.1 mol by silver halide amount of a fine grain emulsion given later. After ripening for 15 minutes, addition of 0.15 mol of the fine grain emulsion and ripening for 15 minutes were repeated twice. After ripening for 2 minutes, the temperature was lowered to 45° C., and an NaOH solution was added to adjust the resulting solution to pH 5.2. Then, the above-described sensitizing dyes C and D were each added in an amount of $5\times10^{-4}$ mol per mol of silver halide.

A sedimenting agent was added, the temperature was lowered to 27° C., the pH was adjusted to 4.0, and the emulsion was washed with water by sedimentation washing according to conventional methods. An aqueous solution of gelatin was added, the temperature was raised to 40° C., and the emulsion was adjusted to pH 6.4 and pCl 2.8. Then, the temperature was elevated to 50° C., and.0 005 mol of an emulsion of fine silver bromide grains having a side length of 0.05 μm was added to this emulsion, followed by addition of a sulfur sensitizing agent and a gold sensitizing agent to conduct optimal chemical sensitization. The observation of the emulsion thus prepared under an electron microscope (TEM) revealed that 80% of all silver halide grains are tabular grains having (100) planes as main planes, the grains having a mean grain size of 1.4 μm, a mean aspect ratio of 6.5 and a mean grain volume of 0.13 $\mu m^3$.

The fine grain emulsion was prepared in the following manner. An aqueous solution of gelatin (containing 1,200 cc of $H_2O$, 24 g of gelatin (M3) having an average molecular weight of 30,000 and 0.5 g of NaCl, pH 3.0) was placed in a reaction vessel, and the temperature was elevated to 23° C. An $AgNO_3$ solution (containing 0.2 g/cc of $AgNO_3$, 0.01 gcc of (M3) and 0.25 cc/100 cc of 1N $HNO_3$)and an NaCl solution (containing 0.07 g/cc of NaCl, 0.01 g/cc of (M3) and 0.25 cc/100 cc of 1N KOH) were concurrently added and mixed at 90 cc/minute for 3 minutes and 30 seconds with stirring. After stirring for 1 minute, the solution was adjusted to pH 4.0 and pCl 11.7.

(Preparation of Silver Chlorobromide Emulsions B-7 to B-9)

Emulsions B-7 and B-8 were prepared by the same emulsion preparing method as with B-6, with the exception that the amount of the silver bromide fine grain emulsion added on sensitization was changed. Emulsion B-9 was prepared by optimal sensitization without addition of the silver bromide fine grain emulsion.

(Preparation of Silver Chlorobromide Emulsion B-10)

An aqueous solution of gelatin (containing 1,200 cc of $H_2O$, 20 g of deionized alkali-treated gelatin (hereinafter referred to as EA-Gel) and 0.8 g of NaCl , pH 6.0) was placed in a reaction vessel. An Ag-1 solution and an X-1 solution were concurrently added and mixed at 50 ml/minute for 15 seconds at 48° C. with stirring.

Here, the Ag-1 solution contains 20 g of $AgNO_3$, 0.6 g of low molecular weight gelatin having an average molecular weight of 20,000 (hereinafter referred to as 2M-Gel) and 0.2 ml of $HNO_3$ (1N) per 100 ml of water, and the X-1 solution contains 7 g of NaCl and 0.6 g of 2M-Gel per 100 ml of water.

Then, an Ag-2 solution (containing 4 g of $AgNO_3$, 0.6 g of 2M-Gel and 0.2 ml of $HNO_3$ (1N) per 100 ml of water) and an X-2 solution (containing 2.8 g of KBr and 0.6 g of 2M-Gel per 100 ml of water) were concurrently added and mixed at 70 ml/minute for 15 seconds. Then, the Ag-1 solution and the X-1 solution were concurrently added and mixed at 25 ml/minute for 2 minutes. An aqueous solution of NaCl (0.1 g/ml) was added in an amount of 15 ml, and the temperature was raised to 70° C. After ripening for 5 minutes, the Ag-1 solution and the X-1 solution were concurrently added and mixed at 10 ml/minute for 15 minutes. Then, for growth of tabular grains, an emulsion of fine AgCl grains 99.9% or more of which have a mean grain size of 0.07 μm and contain no twin and no screw dislocation was added in an amount of 0.2 mol, followed by ripening for 15 minutes. The temperature was lowered to 40° C., and the pH was adjusted to 2.0. After stirring for 20 minutes, the pH was adjusted to 5.2, and 10 ml of a KBr-1 solution (1 g/100 ml KBr) was added, followed by stirring for 5 minutes. Then, after addition of the above-described sensitizing dyes C and D, a sedimenting agent was added, and the emulsion was washed with water according to conventional methods. To this emulsion, 0.005 mol of an emulsion of fine silver bromide grains having a side length of 0.05 μm was added, followed by addition of a sulfur sensitizing agent and a gold sensitizing agent to conduct optimal gold sulfur sensitization. The observation of the emulsion thus obtained under an electron microscope revealed that 80% of all silver halide grains are right-angled parallelogrammic tabular grains having (100) planes as main planes, the grains having a mean grain size of 1.05 μm, a mean aspect ratio of 7.0 and a mean grain volume of 0.13 $\mu m^3$. Further, the coefficient of variation of the grain size distribution of said tabular grains was 0.25. Hereinafter, "mean aspect ratio" means a mean aspect ratio value of silver halide grains having 1.5 or more of aspect ratio, which are obtained by measuring on 500 silver halide grains randomly sampled.

(Preparation of Silver Chlorobromide Emulsions B-11 to B-13)

Emulsions B-11 and B-12 were prepared in the same manner as with silver chlorobromide emulsion B-10, with the exception that the amount of the silver bromide fine grains was changed as shown in Table 1. Emulsion B-13 was prepared without addition of the silver bromide fine grains in the preparation of emulsion B-13.

(Preparation of Silver Iodochlorobromide Emulsion B-14)

Emulsion B-14 was prepared by the same formulation and procedure as with the preparation of silver chlorobromide emulsion B-10, with the exception that the X-2 solution was replaced by an X-3 solution (containing 1.3 g of NaCl, 0.3 g of KI and 0.6 g of 2M-Gel per 100 ml of water).

The observation of the resulting emulsion under an electron microscope revealed that 65% of all silver halide grains are right-angled parallelogrammic tabular grains having (100) planes as main planes, the grains having a mean grain size of 1.10 μm, a mean aspect ratio of 8.0 and a mean grain volume of 0.13 $\mu m^3$. Further, the coefficient of variation of the grain size distribution of said tabular grains was 0.29.

(Preparation of Silver Iodochlorobromide Emulsions B-15 to B17)

Emulsions B-15 and B-16 were prepared in the same manner as with silver iodochlorobromide emulsion B-14, with the exception that the amount of the silver bromide fine grains was changed as shown in Table 1. Emulsion B-17 was prepared without addition of the silver bromide fine grains in the preparation of emulsion B-14.

The $Br^-$ ion density on the surface was determined as the ratio to Ag by the XPS method. The mean $Br^-$ ion density was similarly determined as the ratio to Ag by the fluorescent X-ray method.

The resulting emulsions are shown in Table 1.

TABLE 1

| Emulsion No. | $Br^-$ Content on Surface Average $Br^-$ content | Grain Shape | Plane | Ratio (%) | Coefficient of Variation of Grain Size |
|---|---|---|---|---|---|
| A | 10 | cubic | (100 plane) | 100 | 0.09 |
| B-1 | 8 | cubic | (100 plane) | 100 | 0.09 |
| B-2 | 10 | tabular | (111 plane) | 100 | 0.22 |
| B-3 | 8 | tabular | (111 plane) | 100 | 0.22 |
| B-4 | 3 | tabular | (111 plane) | 100 | 0.22 |
| B-5 | — | tabular | (111 plane) | 100 | 0.22 |
| B-6 | 10 | tabular | (100 plane) | 100 | 0.22 |
| B-7 | 8 | tabular | (100 plane) | 100 | 0.22 |
| B-8 | 3 | tabular | (100 plane) | 100 | 0.22 |
| B-9 | — | tabular | (100 plane) | 100 | 0.22 |
| B-10 | 10 | tabular | (100 plane) | 100 | 0.25 |
| B-11 | 8 | tabular | (100 plane) | 100 | 0.25 |
| B-12 | 3 | tabular | (100 plane) | 100 | 0.25 |
| B-13 | — | tabular | (100 plane) | 100 | 0.25 |
| B-14 | 10 | tabular | (100 plane) | 100 | 0.29 |
| B-15 | 8 | tabular | (100 plane) | 100 | 0.29 |
| B-16 | 3 | tabular | (100 plane) | 100 | 0.29 |
| B-17 | — | tabular | (100 plane) | 100 | 0.29 |

To sample 101 thus obtained, samples 102 to 134 were obtained in the same manner as with sample 101, with the exception that the emulsion of the third layer (green-sensitive emulsion layer) was replaced as shown in Table 2.

TABLE 2

| Sample No. | Emulsion of Third Layer | Mercapto Heterocyclic Compound (I-2-6) (mol/mol Ag) | Remark |
|---|---|---|---|
| 101 | B-1 | 0 | Comparison |
| 102 | B-2 | 0 | Comparison |
| 103 | B-3 | 0 | Comparison |
| 104 | B-4 | 0 | Comparison |
| 105 | B-6 | 0 | Comparison |
| 107 | B-7 | 0 | Comparison |
| 108 | B-8 | 0 | Comparison |
| 109 | B-9 | 0 | Comparison |
| 110 | B-10 | 0 | Comparison |
| 111 | B-11 | 0 | Comparison |
| 112 | B-12 | 0 | Comparison |
| 113 | B-13 | 0 | Comparison |
| 114 | B-14 | 0 | Comparison |
| 115 | B-15 | 0 | Comparison |
| 116 | B-16 | 0 | Comparison |
| 117 | B-17 | 0 | Comparison |
| 118 | B-1 | $5 \times 10^{-4}$ | Comparison |
| 119 | B-2 | $5 \times 10^{-4}$ | Comparison |
| 120 | B-3 | $5 \times 10^{-4}$ | Comparison |
| 121 | B-4 | $5 \times 10^{-4}$ | Comparison |
| 122 | B-5 | $5 \times 10^{-4}$ | Comparison |

TABLE 2-continued

| Sample No. | Emulsion of Third Layer | Mercapto Heterocyclic Compound (I-2-6) (mol/mol Ag) | Remark |
|---|---|---|---|
| 123 | B-6 | $5 \times 10^{-4}$ | Invention |
| 124 | B-7 | $5 \times 10^{-4}$ | Invention |
| 125 | B-8 | $5 \times 10^{-4}$ | Invention |
| 126 | B-9 | $5 \times 10^{-4}$ | Comparison |
| 127 | B-10 | $5 \times 10^{-4}$ | Invention |
| 128 | B-11 | $5 \times 10^{-4}$ | Invention |
| 129 | B-12 | $5 \times 10^{-4}$ | Invention |
| 130 | B-13 | $5 \times 10^{-4}$ | Comparison |
| 131 | B-14 | $5 \times 10^{-4}$ | Invention |
| 132 | B-15 | $5 \times 10^{-4}$ | Invention |
| 133 | B-16 | $5 \times 10^{-4}$ | Invention |
| 134 | B-17 | $5 \times 10^{-4}$ | Comparison |

Further, samples 201 to 234 were prepared in the same manner as with samples 101 to 134, respectively, with the exception that the coating solutions of the third layers were applied after standing for 10 hours after preparation thereof.

Sample 101 thus obtained was exposed to a standard subject, and continuously processed with an automatic paper processor A using the following stages and solutions having the following processing compositions until the replenishment rate of the solutions reached twice the tank capacity of the color development.

| Processing Stage | Temperature (°C.) | Time (sec) | Replenisher* (ml) | Tank Capacity (liter) |
|---|---|---|---|---|
| Color Development | 35 | 45 | 161 | 17 |
| Bleaching-Fixing | 35 | 45 | 215 | 17 |
| Rinsing (1) | 35 | 20 | — | 10 |
| Rinsing (2) | 35 | 20 | — | 10 |
| Rinsing (3) | 35 | 20 | 360 | 10 |
| Drying | 80 | 60 | | |

*Replenishment rate per ml of light-sensitive material Three tank countercurrent system from rinsing (3) to rinsing (2), and from rinsing (2) to rinsing (1) was employed.

The composition of each processing solution was as follows.

| Color Developing Solution: | Tank Solution | Replenisher |
|---|---|---|
| Water | 700 ml | 700 ml |
| Ethylenediaminetetraacetate | 3.0 g | 3.0 g |
| 1,2-Dihydroxybenzene-4,6-disulfonate.2Na | 0.5 g | 0.5 g |
| Potassium Bromide | 0.01 g | — |
| Sodium Chloride | 1.6 g | — |
| Potassium Carbonate | 27 g | 27 g |
| N-Ethyl-N-(β-methanesulfonamidoethyl)-3-methyl-4-aminoaniline Sulfate | 5.0 g | 7.1 g |
| N,N-Di(sulfoethyl)hydroxylamine.2Na | 8.0 g | 10.0 g |
| Sodium Sulfite | 0.1 g | 0.2 g |
| Fluorescent Brightener (WHITEX 4B, Sumitomo Chemical Co., Ltd.) | 1.0 g | 2.5 g |
| Water to make | 1000 ml | 1000 ml |
| pH (25° C.) | 10.05 | 10.45 |

| Bleaching-Fixing Solution: (tank solution and replenisher being the same) | |
|---|---|
| Water | 600 ml |
| Ammonium Thiosulfate (700 g/liter) | 100 ml |
| Ethylenediaminetetraacetic Acid Fe(III) | 55 g Ammonium |
| Disodium Ethylenediaminetetraacetate | 5 g |
| Ammonium Bromide | 40 g |
| Nitric Acid (67%) | 30 g |

-continued

| | |
|---|---|
| Water to make | 1000 ml |
| pH (25° C.) (with acetic acid and aqueous ammonia) | 5.8 |

| Rinsing Solution: (tank solution and replenisher being the same) |
|---|
| Ion-Exchanged Water (the content of each of calcium and magnesium being 3 ppm or less) |

Then, gradation exposure was given through three color separating filter for sensitometry, using a FWH type sensitometer (color temperature of light source: 3200° K.) manufactured by Fuji Photo Film Co., Ltd. The sample to which the exposure was completed was processed using an automatic paper processor previously in the running state as described above.

For the sample to which the processing was completed, the reflection density was measured with a TCD type densitometer manufactured by Fuji Photo Film Co., Ltd. to determine the sensitivity. The sensitivity was defined as the logarithm of the reciprocal of the exposure amount necessary to give a color developing density of 1.0, and indicated by the difference when that of sample 101 was taken as 0.

Further, the difference in sensitivity between samples 101 to 134 and samples 201 to 234 (which were allowed to stand for 10 hours after preparation of the coating solutions) corresponding thereto was determined.

Results obtained are shown in Table 3.

TABLE 3

| Sample No. | Sensitivity | Changes in Sensitivity Due to Coating Solution with Time | Remark |
|---|---|---|---|
| 101 | 0 | −0.020 | Comparison |
| 102 | −0.04 | −0.0.30 | Comparison |
| 103 | −0.06 | −0.035 | Comparison |
| 104 | −0.12 | −0.035 | Comparison |
| 105 | −0.42 | −0.040 | Comparison |
| 106 | 0 | 0 | Comparison |
| 107 | −0.10 | −0.010 | Comparison |
| 108 | −0.20 | −0.010 | Comparison |
| 109 | −0.30 | −0.030 | Comparison |
| 110 | 0 | −0.015 | Comparison |
| 111 | −0.08 | −0.015 | Comparison |
| 112 | −0.18 | −0.020 | Comparison |
| 113 | −0.27 | −0.020 | Comparison |
| 114 | −0.01 | −0.020 | Comparison |
| 115 | −0.07 | −0.020 | Comparison |
| 116 | −0.13 | −0.025 | Comparison |
| 117 | −0.25 | −0.035 | Comparison |
| 118 | 0 | −0.020 | Comparison |
| 119 | −0.03 | −0.025 | Comparison |
| 120 | −0.06 | −0.025 | Comparison |
| 121 | −0.11 | −0.030 | Comparison |
| 122 | −0.40 | −0.035 | Comparison |
| 123 | +0.06 | 0 | Invention |
| 124 | +0.05 | −0.010 | Invention |
| 125 | +0.02 | −0.010 | Invention |
| 126 | −0.28 | −0.030 | Comparison |
| 127 | +0.06 | ±0 | Invention |
| 128 | +0.04 | ±0 | Invention |
| 129 | +0.02 | ±0 | Invention |
| 130 | −0.22 | −0.030 | Comparison |
| 131 | +0.05 | −0.005 | Invention |
| 132 | +0.04 | −0.005 | Invention |
| 133 | −0.02 | −0.005 | Invention |
| 134 | −0.25 | −0.040 | Comparison |

As apparent from the results of Table 3, samples 123 to 125, 127 to 129 and 131 to 133 of the present invention in which the tabular emulsion grains having the (100) planes and the mercapto heterocyclic compounds according to the present invention were used are preferably high in sensitivity and small in changes in photographic properties even if a long period of time elapsed from the preparation of the coating solutions to the coating. Further, the results also reveal that samples 127 to 129 and 131 to 133 in which emulsions B-10 to B-12 and B-14 to B-16 provided with the discontinuous gaps in $Br^-$ or $I^-$ content in the center portions of the grains were used are preferably small in changes in sensitivity due to the elapse of time after preparation of the coating solutions. In contrast, the results show that samples 119 to 121 in which emulsions B-2 to B-5 comprising the tabular grains having the (111) planes not contained in the present invention were used are remarkably low in sensitivity and large in changes in sensitivity due to the elapse of time after preparation of the coating solution, even if they were used in combination with the mercapto heterocyclic compounds.

Further, the results reveal that samples 122, 126, 130 and 134 in which emulsions B-5, B-9, B-13 and B-17 having no silver bromide-rich phases on the surfaces of the grains were used are low in sensitivity and show significant changes in sensitivity due to the elapse of time after preparation of the coating solutions, even if they were used in combination with the mercapto heterocyclic compounds.

Furthermore, the results show that samples 106 to 108, 110 to 112 and 114 to 116 in which no mercapto heterocyclic compounds were used are relatively low in sensitivity.

According to the present invention, the photographic materials can be obtained which are rapidly processable, high in sensitivity, and small in the difference between production lots caused by changes in sensitivity due to the elapse of time after preparation of the coating solution on production.

While the invention has been described in detail and with reference to specific embodiments thereof, it will be apparent to one skilled in the art that various changes and modifications can be made therein without departing from the spirits and scope thereof.

What is claimed is:

1. A silver halide color photographic material comprising a silver halide emulsion layer containing a cyan dye forming coupler, a silver halide emulsion layer containing a magenta dye forming coupler, and a silver halide emulsion layer containing a yellow dye forming coupler on a reflective support, wherein at least one layer of said silver halide emulsion layers comprises silver halide emulsion grains and compounds represented by the following general formulas (I) and (II), said emulsion grains being tabular silver halide emulsion grains having (100) planes as main planes and a silver chloride content of 90 mol % or more, and further where the mean bromide ion content on surfaces of said emulsion grains is twice or more that of the whole emulsion grains:

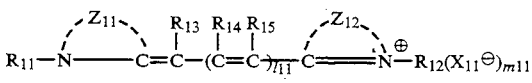

(I)

wherein $Z_{11}$ and $Z_{12}$, which are the same or different, each represents an atomic group forming 5-membered or 6-membered nitrogen-containing heterocyclic nuclei; $l_{11}$ represents 0, 1 or 2; $R_{11}$ and $R_{12}$, which are the same or different, each represents an alkyl group or an alkenyl group; $R_{13}$ and $R_{15}$, which may be the same or different, each represents a hydrogen atom, or an atomic group necessary for forming a 5-membered or 6-membered ring by combining $R_{13}$ with $R_{11}$ or $R_{15}$ with $R_{12}$; when $l_{11}$ is 2, $R_{15}$ in a central potion of a methine chain also represents a lower alkyl group; $R_{14}$ represents a hydrogen atom or a substituent group selected from among aryl groups, alkylthio groups, and lower alkyl groups, or an atomic group necessary for forming a 6-membered carbon ring by combining two groups represented by $R_{14}$ which are different each other when $l_{11}$ is 2; $X_{11}$ represents a pair ion necessary for neutralization of electric charge; and $m_{11}$ represents 0 or 1, $m_{11}$ being 0 when said compound of formula (I) is an internal salt;

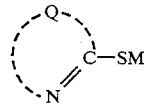

(II)

wherein Q represents an atomic group necessary for forming a 5-membered or 6-membered heterocycle or a 5-membered or 6-membered heterocycle formed by condensation of benzene rings; and M represents a cation.

2. The silver halide color photographic material as claimed in claim 1, wherein tabular grains having (100) planes as main planes and an aspect ratio (diameter/thickness) of 1.5 or more occupy 35% or more of the total of projected areas of the whole silver halide emulsion grains in the silver halide emulsion layer containing said tabular silver halide emulsion grains having a silver chloride content of 90 mol % or more, and center portions of said tabular grains having the (100) planes as main planes and an aspect ratio of 1.5 or more each has at least one gap phase discontinuous in halogen composition, said gap being a difference of 10 to 100 mol % in $Cl^-$ content or $Br^-$ content and/or a difference of 5 to 100 mol % in $I^-$ content.

3. The silver halide color photographic material as claimed in claim 2, wherein the center portions of said tabular grains having the (100) planes as main planes and an aspect ratio of 1.5 or more have at least one gap phase discontinuous in halogen composition, said gap being a difference of 30 to 100 mol % in $Cl^-$ content or $Br^-$ content.

4. A silver halide color photographic material as claimed in claim 1, wherein the mean bromide ion content on the grain surfaces of said silver halide emulsion grains is 3 to 200 times that of the whole emulsion grains.

5. A silver halide color photographic material as claimed in claim 1, wherein said silver halide emulsion grains have silver bromide-localized phases on the surfaces of the silver halide grains.

6. A silver halide color photographic material as claimed in claim 5, wherein the silver bromide content of said silver bromide-localized phases on the surfaces of the silver halide grains is at least 10 mol %.

7. A silver halide photographic material as claimed in claim 1, wherein said tabular silver halide grains having the (100) planes as main planes have a silver chloride content of 95 mol % or more.

8. A silver halide photographic material as claimed in claim 1, wherein the projected areas of said tabular silver halide grains having the (100) planes as main planes occupy 60 to 100% of the total of the projected areas of the whole silver halide grains in the emulsion.

9. A silver halide photographic material as claimed in claim 2, wherein an aspect ratio of said tabular silver halide grains having the (100) planes as main planes is 3 to 25.

10. A silver halide photographic material as claimed in claim 2, wherein a grain size distribution is monodisperse and a coefficient of variation of said tabular silver halide grains having the (100) planes as main planes is 20% or less.

11. A silver halide photographic material as claimed in claim 1, wherein said 5-membered or 6-membered nitrogen-containing heterocyclic nuclei represented by $Z_{11}$ and $Z_{12}$ includes thiazole, benzothiazole, naphthothiazole, dihydronaphtho-thizole, selsnazole, benzoselenazole, naphthoselsnazole, dihydronaphthoselenazole, oxazole, benzoxazole, naphthoxazole, benaimidazole, naphthoimdazole, pyridine, quinoline, imidazo[4,5-b]quinoxaline and 3,3-dialkylindolenine when $1_{11}$ is 0 or 1, and benzothiazole, benzoselenazole, benzoxazole, naphtoxazole, benzimidazole and naphthimidazole, when $1_{11}$ is 2.

12. A silver halide photographic material as claimed in claim 1, wherein said substituted or unsubstitute alkyl groups and substituted or unsubstituted alkenyl groups represented by $R_{11}$ and $R_{12}$ each has 10 or less carbon atoms.

13. A silver halide photographic material as claimed in claim 1, wherein said substituent represented by $R_{14}$ includes an aryl group, an alkylthio group and lower alkyl group.

14. A silver halide photographic material as claimed in claim 1, wherein said compound represented by general formula (I) is used in an amount of $4\times10^{-6}$ to $8\times10^{-3}$ mol per mol of silver halide.

15. A silver halide photographic material as claimed in claim 1, wherein an atomic group represented by Q is imidazole, tetrazole, thiazole, oxazole, selenazole, benzimidazole, naphthoimidazole, benzothiazole, naphthothiazole, benzoselsnazole, naphthoselenazole or benzoxazole.

16. A silver halide photographic material as claimed in claim 1, wherein said cation represented by M is a hydrogen ion, alkali metals or an ammonium ion.

17. A silver halide photographic material as claimed in claim 1, wherein said compound represented by general formula (II) is selected from the mercapto compound represented by the following general formulas (II-1), (II-2), (II-3) and (II-4):

General formula (II-1)

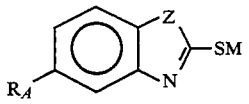

wherein $R_A$ represents a hydrogen atom, an alkyl group, an alkoxyl group, an aryl group, a halogen atom, a carboxyl group or a salt thereof, a sulfo group or a salt thereof, or an amino group; Z represents —NH—, —O— or —S—; and M has the same meaning as M defined in general formula (II).

General formula (II-2)

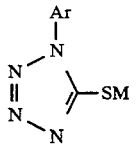

wherein Ar represents:

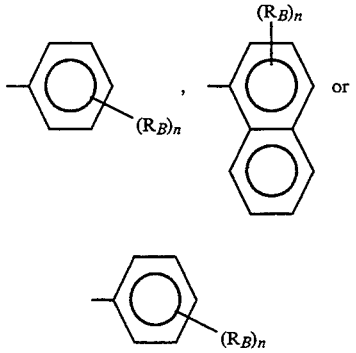

wherein $R_B$ represents an alkyl group, an alkoxyl group, a carboxyl group or a salt thereof, a sulfo group or a salt thereof, a hydroxyl group, an amino group, an acylamino group, a carbamoyl group or a sulfonamido group; n represents an integer of 0 to 2; and M has the same meaning as M defined in general formula (II).

General formula (II-3)

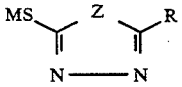

wherein Z represents —N($R_{A1}$)—, an oxygen atom or a sulfur atom; R represents a hydrogen atom, an alkyl group, an aryl group, an alkenyl group, a cycloalkyl group, —$SR_{A1}$, —N($R_{A2}$)$R_{A3}$, —NHCO$R_{A4}$, —NH-$SO_2R_{A5}$ or a heterocyclic group wherein $R_{A1}$ represents a hydrogen atom, an alkyl group, an alkenyl group, a cycloalkyl group, an aryl group, —CO$R_{A4}$ or —$SO_2$-$R_{A5}$, $R_{A2}$ and $R_{A3}$ represent hydrogen atoms, alkyl groups or aryl groups, and $R_{A4}$ and $RA_{A5}$ represent alkyl groups or aryl groups; and M has the same meaning as M defined in general formula (II).

General formula (II-4)

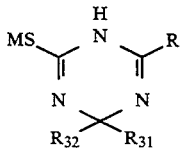

wherein R and M each has the same meaning as R and M defined in general formula (II-3); and $R_{B1}$ and $R_{B2}$ each has the same meaning as $R_{A1}$ and $R_{A2}$ defined in general formula (II-3).

18. A silver halide photographic material as claimed in claim 1, wherein said compound represented by formula (II) is used in an amount of $1\times10^{-5}$ to $5\times10^{-2}$ per mol of silver halide.

* * * * *